US008162248B2

(12) United States Patent
Kuraoka

(10) Patent No.: US 8,162,248 B2
(45) Date of Patent: Apr. 24, 2012

(54) DOCUMENT SHREDDER DEVICE

(76) Inventor: Toshiaki Kuraoka, Fujisawa (JP)

( * ) Notice: Subject to any disclaimer, the term of this patent is extended or adjusted under 35 U.S.C. 154(b) by 1460 days.

(21) Appl. No.: 11/630,439

(22) PCT Filed: Jun. 24, 2005

(86) PCT No.: PCT/JP2005/011626

§ 371 (c)(1),
(2), (4) Date: Dec. 22, 2006

(87) PCT Pub. No.: WO2006/001370

PCT Pub. Date: Jan. 5, 2006

(65) Prior Publication Data

US 2008/0179436 A1 Jul. 31, 2008

(30) Foreign Application Priority Data

| | | |
|---|---|---|
| Jun. 26, 2004 | (JP) | 2004-216592 |
| Jun. 26, 2004 | (JP) | 2004-216593 |
| Jun. 26, 2004 | (JP) | 2004-216596 |
| Dec. 3, 2004 | (JP) | 2004-382277 |
| Dec. 3, 2004 | (JP) | 2004-382278 |
| May 16, 2005 | (JP) | 2005-171588 |

(51) Int. Cl.
*B02C 11/02* (2006.01)
*B02C 21/00* (2006.01)
*B02C 23/00* (2006.01)

(52) U.S. Cl. ..... 241/200; 241/223; 241/243

(58) Field of Classification Search ..... 241/223, 241/243, 200

See application file for complete search history.

(56) References Cited

U.S. PATENT DOCUMENTS

| | | | | | |
|---|---|---|---|---|---|
| 4,059,235 | A | * | 11/1977 | Bryant | 241/223 |
| 4,119,277 | A | * | 10/1978 | Snyder et al. | 241/167 |
| 4,192,467 | A | * | 3/1980 | Hatanaka | 241/34 |
| 4,231,530 | A | * | 11/1980 | Hatanaka | 241/223 |
| 4,529,134 | A | * | 7/1985 | Williams | 241/30 |
| 4,627,577 | A | * | 12/1986 | Hyuga et al. | 241/30 |
| 4,815,670 | A | * | 3/1989 | Iwai | 241/34 |
| 4,817,877 | A | * | 4/1989 | Itoh et al. | 241/34 |
| 5,261,614 | A | * | 11/1993 | Schwelling | 241/167 |

(Continued)

FOREIGN PATENT DOCUMENTS

| | | |
|---|---|---|
| JP | 132548/1983 | 9/1983 |

(Continued)

*Primary Examiner* — Bena Miller

(74) *Attorney, Agent, or Firm* — Bacon and Thomas, PLLC

(57) ABSTRACT

A document shredder is provided with a transport system that holds and transports paper, and a shredding system that shreds the paper while rotating at a circumferential speed higher than a transporting speed of the transport system, wherein, a part of elements constituting the transport system is in common with a part of elements constituting the shredding system and a point of action of the transport system is placed substantially at the same position as a point of action of the shredding system, with respect to a paper transporting direction, and alternatively, the shredding system is arranged successively from the transport system. Since this shredder is assembled in such a manner that a part of elements constituting the transport system to hold and transport the paper is in common with a part of elements constituting the shredding system, it is possible to be downsized. Furthermore, since the points of action are provided independently from the transport system, it is possible to enlarge the speed ratio between the paper transporting speed and the rotating speed of the shredding blade, whereby the paper entirely up to the end can be shredded with reliability, by only onetime passing of the paper.

9 Claims, 21 Drawing Sheets

U.S. PATENT DOCUMENTS

| | | | | |
|---|---|---|---|---|
| 5,354,003 | A * | 10/1994 | Stokes | 241/101.763 |
| 5,375,775 | A * | 12/1994 | Keller et al. | 241/19 |
| 5,954,278 | A * | 9/1999 | Bennett et al. | 241/27 |
| 6,491,245 | B1 * | 12/2002 | Rajewski | 241/223 |
| RE40,126 | E * | 3/2008 | Rajewski | 241/223 |
| 7,357,340 | B2 * | 4/2008 | Castronovo | 241/30 |
| 2004/0188556 | A1 * | 9/2004 | Jong | 241/243 |
| 2005/0167536 | A1 * | 8/2005 | Chojnacki | 241/223 |
| 2005/0241998 | A1 * | 11/2005 | Nemedi | 209/3 |

FOREIGN PATENT DOCUMENTS

| | | |
|---|---|---|
| JP | 63-296854 | 12/1988 |
| JP | 05-007789 | 1/1993 |
| JP | 11-229284 | 8/1999 |
| JP | 2002-175963 | 1/2002 |

* cited by examiner

DOCUMENT SHREDDER DEVICE

TECHNICAL FIELD

The present invention relates to a document shredder that finely shreds a document to be discarded for the purpose of maintaining confidentiality, and discards the document whose contents are rendered unreadable. More particularly, the present invention relates to a document shredder that is able to supply shredded paper containing a paper fiber being kept long without being cut off, thereby allowing the shredded paper to be suitable for recycling.

RELATED ART

A currently dominant document shredder employs a method to cut out paper, by using round blades that are rotated in such a manner as being opposed to and in contact with one another. However, since fibers in the pieces of paper being cut out by those cutting blades are broken away, the usage as recycled paper is limited. In order to address this problem, there is developed an apparatus that considers usage of paper after the cutoff, and shreds paper by tearing, not by cutting off. For example, Patent document 1 suggests an apparatus that is provided with multiple rotating blades on each of a pair of rotating shafts, one rotating shaft being set to rotate more rapidly than the other rotating shaft, and these shafts are arranged so that the blades on each shaft alternately bite into transported paper, whereby the paper is torn, by the use of the speed difference between the two rotating shafts.

For the document shredder as described above, it is necessary to avoid that an end of the paper is ejected without being processed. In the apparatus disclosed in the Patent document 1, the diameters of the rotating blades are configured to be large so that the length holding the paper is made longer, thereby allowing the paper to be processed up to the end.

However, if the diameters of the rotating blades are configured to be large, a speed ratio between the pair of the rotating blades cannot be made large. Accordingly, a sufficient shredding force is hardly generated by utilizing the speed ratio only. Therefore, in the apparatus as disclosed by the Patent document 1, the processed paper is put between the rotating blades once again, so that the paper is shredded with reliability. Enlarging the diameters of the rotating blades and setting up a mechanism to once again shred the paper already subjected to shredding process, may cause upsizing of the apparatus. Furthermore, a material which has a high abrasion resistance is required as a shredding blade in the conventional document shredder, causing a problem that this requirement becomes a burdensome in maintenance wise, in order to keep a high processing ability.

As for a processing on the paper after being shredded, conventionally, there is known a configuration as a compressor in which a screw is rotated inside a tubular member (Patent document 2). In this apparatus, the tubular member is structured in such a manner that an internal diameter is narrowed gradually toward an outlet end. Waste pieces of paper being shredded are moved toward the outlet end by the screw rotation, pressed against an inner wall of small-diameter part which is positioned in proximity to the outlet, compressed firmly, and then a compressed object is ejected from the outlet end. The Patent document 2 discloses, in order to prevent a phenomenon that the compressed pieces of paper are jamming at the small-diameter part of the tubular member, the small-diameter part is made of an elastic resin or the like, thereby providing elasticity to the wall surface of the small-diameter part.

However, since the compressor as disclosed by the Patent document 2 has a structure that the pieces of paper are pressed into the small-diameter part, the pieces of paper tend to be pressed by a large force against the wall surface near the inlet of the small-diameter part. Therefore, there is a problem that the pieces of paper tend to jamming. This problem of jamming may be improved to a certain extent by providing elasticity to the wall surface, but it cannot be a drastic resolution. In addition, a degree of compression (hardness) required for the compressed object made of the pieces of paper may be different depending on how it is to be recycled. However, in order to change the degree of compression in the structure of the compressor as described in the Patent document 2, modification of the elasticity of the wall surface is necessary, and accordingly there is a problem that it is not easy to change the compression degree.

[Patent document 1]

Japanese Published Unexamined Patent Application No. 2003-1131

[Patent document 2]

Japanese Published Unexamined Patent Application No. 2002-137096

DISCLOSURE OF THE INVENTION

Problem to be Solved by the Invention

A first object of the present invention is to provide a document shredder that is small in size, while allowing a speed ratio between a paper transporting speed and a rotating speed of shredding blade to be large, and is capable of shredding the paper entirely up to the end with reliability, by only onetime passing of the paper. The present invention aims at enabling a use of shredding blade, which is prepared by a press working, thereby reducing a burdensome such as maintenance. The present invention further aims at providing a paper feeder that is suitable for the document shredder as described above.

A second object of the present invention is to provide a compressor that enables compressing and ejecting of pieces of paper without jamming thereof. The present invention further aims at providing a compressor that is capable of easily changing a compression degree.

Means to Solve the Problem

A document shredder to achieve the first object is provided with a transport unit that holds and transports paper, and a shredding unit that shreds the paper while rotating at a circumferential speed higher than a paper transporting speed of the transport unit, wherein, a component of the transport unit is also a component of the shredding unit, and a point of action on the paper by the paper transport unit is positioned substantially at the same position as a point of action on the paper by the shredding unit, with respect to the paper transporting direction and is spaced from the point of action of the shredding unit in a direction orthogonal to the paper transporting direction. Alternatively, the shredding unit is arranged in succession from the transport unit.

The document shredder according to an aspect of the present invention is provided with, for example, a first drive shaft, a second drive shaft that is rotated at a higher speed than the first drive shaft, a transport unit that is fixed on the first drive shaft and forwards paper, and a shredding unit that is fixed on the second drive shaft and tears the paper, wherein, the first drive shaft is equipped with a shredding auxiliary unit that is rotated being driven by the shredding unit that is fixed on the second drive shaft.

The document shredder according to an aspect of the present invention is provided with, for example, a paper transport unit that transports paper, a shredding unit that has a rotating shaft and shredding blades fixed on the rotating shaft to tear the paper, and that rotates the shredding blades at a circumferential speed higher than a transport speed of the paper transport unit, and a unit to forward the paper, being rotatably supported by the rotating shaft and engaged with a part of the paper transport unit, to hold the paper and forward the paper at a transport speed of the transport unit, during an operation tearing the paper by the shredding blades.

The document shredder according to an aspect of the present invention is provided with a paper transport unit that transports the paper, and a shredding unit that has a rotating shaft and shredding blades fixed on the rotating shaft to tear the paper, and rotates the shredding blades at a circumferential speed higher than the transport speed of the paper transport unit, wherein, the paper transport unit is further provided with a pulley(s) that rotates about the shaft, and a conveyor belt(s) that is brought into contact by pressure with a peripheral plane of the pulley, and holds the paper at a pressure-contact part having an arc shape that is formed between the conveyor belt and the peripheral plane, wherein the shredding blades of the shredding unit is placed in proximity to the pressure-contact part.

The document shredder is provided with a pair of shredding units that are fixed on a pair of drive shafts, respectively, and arranged in such a manner as opposed to each other, and a pair of paper transport-use gears arranged in proximity to a part to feed paper toward the pair of shredding units, wherein each of the drive shafts has a gear being formed at a part where at least the shredding unit is not fixed, and is provided with a transmission gear which decelerates a power of the drive shafts and transmits the power to the paper transport-use gears.

A paper feeder for use in a document shredder according to an aspect of the present invention is provided with a paper storage that stores paper, a conveyor belt(s) that transports the paper to the document shredder, and a drive unit that moves the conveyor belt, wherein the paper storage has an opening on the bottom, to bring the paper into contact with the conveyor belt, and is provided with a separating unit that separates the paper ejected from the paper storage according to the contact with the conveyor belt, so as to obtain a volume processible by the document shredder.

A shred compressor according to an aspect of the present invention to achieve the second object of the present invention includes a compression room having an input port and an outlet port for shreds, and a shred compressing mechanism part that is placed at the input port, wherein at the outlet port of the compression room, there are arranged pressure walls openable and closable and a pressing member that applies a given pressure in the direction to close the pressure walls.

In this situation above, for example, it is possible to configure such that the compression room is a tubular shaped member having an inner diameter without any unevenness, the input port and the outlet port are arranged face to face, and the shred compressing mechanism part has a mechanism to apply a force to push the shreds from the input port toward the pressure walls at the outlet port.

The shred compressor according to an aspect of the present invention further includes, for example, a compression room having an input port and an outlet port for shreds, and a shred compressing mechanism part placed at the input port, wherein, the shred compressing mechanism part includes a rotating member that rotates within an aperture of the input port, and a drive shaft that drives the rotating member.

For instance, the rotating member is a shaft-like member, the shaft-like member being equipped with at least one roller, and the roller comes into contact with a compressed object of shreds within the compression room by rotating within the aperture of the shaft-like member, and rolls around the end face of the compressed object.

In addition, a container to receive the shreds is placed outside of the input port, a coil-shaped wire rod is provided within the container, the coil-shaped wire rod is fixed on the drive shaft, and the shreds within the container are transported to the input port by rotating the coil-shaped wire rod in accordance with rotating the drive shaft.

Effect of the Invention

The shredder according to an aspect of the present invention is small in size, because the transport system that holds and transports the paper and the shredding system are incorporated in such a manner as having a part of elements in common, and since the point of action is provided independently from the transport system, it is possible to enlarge the speed ratio between the paper transporting speed and the rotating speed of the shredding blade. Furthermore, shredding is performed while the paper up to the end is firmly held by the transport system, whereby it is possible to shred the paper entirely up to the end with reliability, by only onetime passing of the paper.

PREFERRED EMBODIMENTS OF THE INVENTION

Hereinafter, exemplary embodiments of a document shredder and a shred compressor according to an aspect of the present invention will be explained. FIG. 1 illustrates an overview of the document shredder according to an aspect of the present invention, and the document shredder is provided with a paper feeder 100 that stores waste paper and separates the paper to feed an appropriate volume thereof, a shredding part 200 that subjects paper P fed from the paper feeder 100 to a shredding process, and a compression part 300 that compresses a shred P' after shredded by the shredding part 200.

As shown FIG. 2, the paper feeder 100 is provided with a paper storage 110 that is capable of storing a large volume of paper to be discarded collectively, a paper separation mechanism 120 that takes out an appropriate number of sheets of paper P separately from the paper storage 110, and a paper transport mechanism 130 made up of a belt 131 and pulleys 132. There are two or more lines of belt 131 being provided in the width direction of the paper (in the vertical direction with respect to the plane of the figure). The paper storage 110 is formed by a box-like member to store the paper to be discarded in such a manner as being stacked therein. A part of its bottom is opened so that a sheet on the lower end of the paper being stored comes into contact with the belt 131 of the paper transport part 130. A paper ejecting side of the paper storage 110 is also provided with an opening so as to enabling ejection of the paper.

The paper transport mechanism 130 is provided with the pulleys 132 more than one, the belt 131 that is looped over these pulleys, and a paper guide 135 that guides transporting of the paper. One of the multiple pulleys is rotary-driven by a power source not illustrated. The rotation of this pulley 132 turns the belt 131 counterclockwise in the figure, and ejects the paper being in contact with the belt 131 at the lower end of the paper storage 110, to the left in the figure. It is to be noted that in the embodiment as shown in the figure, the paper transport mechanism 130 also serves as a transporting system for the shredding part 200 being a subsequent element, and the transport mechanism 130 is provided with a roller and the like, on which a shredding blade as described below is fixed. In order to downsize the overall apparatus, the example as illustrated is preferable. However, the paper transport system for the paper feeder 100 and that for the shredding part 200 may be provided independently of each other.

The paper separation mechanism 120 is provided with a separation member 121 mounted on the lower end of the paper storage 110 on the paper ejection side, a sensor 122 that detects the forefront of the paper being ejected from the paper storage 110, an eccentric cam 123 that is driven by a paper detection signal from the sensor 122, and a lifter 124 that is driven by the eccentric cam 12 to restrict the transport of the paper. The separation member 121 is made of a material having a high frictional coefficient on the surface thereof, and a space between the separation member and the belt 131 is set to become narrower toward the traveling direction of the paper, thereby restricting the number of sheets of paper that is going to come out from the paper storage 110, to one or two sheets. The separation member 121 is made of a rubber roller incorporating a one-way clutch, for example, and it is rotatable about a given shaft. This rotation may be locked in the transporting direction of the paper, but freely rotatable in the reverse direction, thereby facilitating a takeout of paper at the time of jamming.

The lifter 124 is provided at a position being opposed to the bottom of the paper storage 110, placing the belt 131 therebetween, and the lifter moves up and down every rotation of the eccentric cam 123. The lifter 124 and the belt 131 are positioned in such a manner as being displaced from each other in the width direction of the paper (the vertical direction with respect to the plane of the figure), so that the vertical movement of the lifter 124 does not interfere with the belt 131. In addition, one end of the lifter 124 on the surface being in contact with the paper is provided with a projection 125 that is made of a material having a high frictional coefficient. When the sensor 122 detects the forefront of the paper and the eccentric cam 123 is rotated, the lifter 124 goes up, and firstly the projection 125 comes into contact with the lower end of the paper having not been ejected and remaining there, thereby stopping the transport thereof. When the lifter 124 goes up further, the lifter 124 lifts the whole paper and breaks off contact between the belt 131 and the paper, thereby stopping the transport of the remaining paper.

An operation of the paper feeder 100 in the configuration as described above will be explained. When the pulleys 132 are rotatively driven by the power source not illustrated and the belt 131 is rotated, a sheet of paper on the lowermost part being in contact with the belt 131 is extracted from the paper storage 110, out of the paper being stored in the paper storage 110. On this occasion, a number of sheets, corresponding to a space set between the ejection side opening of the paper storage 110 and the belt 131, are transported and come out from the paper storage 110. When the sheets reach the separation member 121, an uppermost sheet of the paper firstly comes into contact with its tapered part, movement of the sheets is stopped, and finally, only one or two sheets are allowed to pass through the separation member 121.

When the forefront of the paper having passed through the separation member 121 is detected by the paper sensor 122, the two eccentric cams 123 are rotated accordingly, and the lifter 124 is lifted. Firstly, the projection 125 of the lifter 124 comes into contact with the paper remaining in the paper storage 110 to stop the transport thereof, and the lifter 124 further goes up and lifts the whole paper, thereby breaking off the contact with the belt 131. Accordingly, a subsequent transport of the paper is suspended. The paper, which has passed the separation member 121 during time difference between when the projection 125 comes into contact with the subsequent sheet and when the whole paper are lifted, is ejected from the paper storage 110 without any restraint on moving and transported to the shredding part 200. When the eccentric cams 123 are rotated more, the lifter 124 returns to a position lower than the belt 131, and at this time, the sheet of paper that comes to the lower end in the paper storage 110 becomes available for being transported.

As thus described, the paper feeder 100 according to the present embodiment separates and ejects only the number of sheets corresponding to the count limited by the paper storage 110, and restricts with reliability the movement of the paper remaining in the paper storage 110, thereby preventing an occurrence of jamming and feeding the sheets of paper to the shredding part 200, where the count of the sheets is surely limited to a small number.

It is to be noted here that in the above embodiment, an example has been explained, in which a single separation member 121 is provided on the edge of the paper storage 110. However, as shown in FIG. 3, for example, multiple separation members 121 may be provided (121*a*, 121*b*). In this case, a space between the separation member 121*b* on the rear stage and the belt 131 is adjusted so that the space corresponds to approximately a thickness of one sheet of paper. This enables the separation member 121*a* on the front stage to separate two or three sheets, and finally allowing one sheet to be separated and fed into the shredding part 200. As for the shape of the separation member 121, since it is only required that a space between the separation member 121 and the belt is made narrower toward the paper traveling direction, the separation member may be not only in a shape of roller as shown in FIG. 2, but also in a shape of taper.

Another exemplary embodiment of the paper feeder 100 will be explained with reference to FIG. 4 and FIG. 5. The paper feeder 100 as shown in FIG. 4 features that it is provided with a mechanism to resolve a paper jam, though a basic configuration thereof is the same as the configuration as shown in FIG. 2. Such mechanism as described above according to the exemplary embodiment as shown in FIG. 4 is provided with an eccentric roller 140 on a shaft 137 of the pulley 132, which is located near the opposite side of the paper outlet of the paper storage 110. The pulley 132 freely rotates about the shaft 137 and the rotation is driven by the belt. On the other hand, the eccentric roller 140 is fixed on the shaft 137 and the drive of the shaft 137 allows the eccentric roller 140 to rotate independently of the belt transporting system. The shaft 137 is driven, for example, by a signal from the sensor that detects a paper jam. The eccentric roller 140 has a surface made of a high friction material, and a part thereof has a convex shape relative to the shaft 137. A position of the eccentric roller 140 in the direction of the shaft 137 does not interfere with the belt 131, and the convex part thereof is allowed to come into contact with the lower side of the paper, by the rotation of the eccentric roller 140. The eccentric roller rolls up a paper edge by a frictional force in a counterclockwise direction.

In this configuration as described above, if there is a case, for example, where the paper stops at the outlet of the paper storage 110 or in front of the separation member 121 because the sheets of paper are stapled or folded, it is recognized as a paper jam under the condition that a paper existence sensor detects a sheet of paper on the bottom of the storage and a paper passage sensor located between the separation part and the shredding part does not detect paper for a predetermined period of time. Then, the shaft 137 is rotated, thereby rotating the eccentric roller 140 in the counterclockwise. Accordingly, the convex part of the eccentric roller 140 rapidly lifts the edge part E of the paper, and moves the paper forward in the condition that a contact pressure between the paper and the eccentric roller 140 is steeply increased. Therefore, the rear end of the paper is curved and swelled, generating a pressure to increase the contact pressure with the belt, whereby the edge part of the paper is rolled up by the belt and transported forward in a state of being reversed. When the edge part of the paper is transported, and reaches the outlet being narrowed, the paper is transported below the sheets of paper being jammed. Therefore, the transported paper is captured without coming into contact with the separation roll. Further, even if the paper includes a part being thicker than other parts due to a wrinkle and the like, buckling occurs on the separation roll and the belt, and consequently, a force for transporting overcomes a force for stopping, thereby passing the paper through the outlet, and the paper is fed into the shredding part.

As thus described, if the sheets of paper are stapled or clipped, the edge part being stapled or clipped are set on the forefront in the paper transporting direction, thereby allowing the paper to be rolled up, sheet by sheet, and stripped off the portion being stapled. Therefore, it is possible to feed the paper in the shredding part without jamming at the outlet.

The paper feeder 100 as shown in FIG. 5 features that it is provided with a belt abrasive mechanism 150, though a basic configuration thereof is the same as the configuration as shown in FIG. 2. In other words, in proximity to the pulley 132 of the belt transporting system, there is installed an arm 152 that is rotatable about a supporting point 151, and a grindstone 153 to whet the belt is fixed on one end of the arm. On the other end of the arm, there is fixed a driving source to drive the arm 152, for example, an electromagnetic solenoid 154 and a return spring 155. There is also provided a counter that counts the number of processed paper, not illustrated. The counter inputs a signal from a sensor that detects the forefront of the paper, or a signal from an encoder installed on the pulley, so that the number of the processed paper is counted, and when the counted number reaches a certain number, the electromagnetic solenoid 154 is energized.

Accordingly, the electromagnetic solenoid 154 contracts to allow the arm 152 to rotate in counterclockwise in the figure. Then, the grindstone 153 comes into contact with the belt 131 being rotated. The surface of the belt 131 is abraded by the contact with the grindstone 153, thereby resuming the high friction state. Energizing of the electromagnetic solenoid 154 is controlled by a timer, for example, and energizing is terminated after a lapse of predetermined period of time. When the energizing is terminated, the arm 152 resumes the original state by a force of the return spring 155, and the grindstone 153 is separated from the belt 131 and the abrasion is finished.

Next, an explanation will be made regarding the shredding part 200. The shredding part 200 of the document shredder according to the present invention features that it is provided with a transport system that holds and transports paper, and a shredding system that shreds the paper while rotating at a circumferential speed higher than a transporting speed of the transport system, a part of elements constituting the transport system is in common with a part of elements constituting the shredding system, and a point of action of the transport system is located substantially at the same position as a point of action of the shredding system, with respect to a paper transporting direction, or the shredding system is arranged successively from the transport system. A specific embodiment to achieve the configuration as described above includes an example that combines a belt transport system and pulleys (first example), and an example that uses a gear (second example), and the like. Hereinafter, an explanation will be made in detail with regard to the shredding part according to each of the examples.

FIRST EXAMPLE

FIG. 6 and FIG. 7 each illustrate a first exemplary embodiment of the shredding part that utilizes the belt transport system and pulleys. This shredding part 200 is provided with a transport system 230 made up of pulleys and belts, a mechanism that shreds paper, and a hopper 240 in which the paper after shredded are ejected. The mechanism that shreds the paper is connected to a driving force not illustrated, and provided with a first shaft 210 and a second shaft 220 that respectively rotate in opposite directions, plate-like shredding blade 211 being fixed on the first shaft 210, and plate-like shredding a blade 221 that is fixed on the second shaft 220 and shred (tear) the paper in cooperation with the shredding blade 211.

The paper transport system of the paper feeder 100 described above may also serve as the transport system 230. In the exemplary embodiment as illustrated, the transport system 230 is made up of three pulleys 232*a*, 232*b*, and 232*c*, the belt 231 that is looped over the pulleys 232, press rollers 234, and a paper guide 235. The belt 231 is made of a material having a high frictional coefficient (rubber) or processed into a fine convexo-concave shape, for instance, in order to render the surface to have a high frictional coefficient. The belt 231 may be large in width to be suitable for the paper width. However, in this exemplary embodiment, the belt 231 is configured in such a manner that multiple lines of belt are arranged side by side in the width direction of the paper. One of the three pulleys is a driving pulley that is connected to the driving source not illustrated, and rotates the belt 231 in a counterclockwise in the figure. A mechanism to perform shredding is fixed below the pulley 232*a* that is located in the lower side of the transport system.

As for the two shafts 210 and 220 that constitute the shredding mechanism, the shaft 210 rotates in a clockwise direction, and the shaft 220 rotates in a counterclockwise direction. These shafts rotate at a speed higher than the a speed to transport the paper by the transport system, thereby allowing the shredding blades 211 and 221 fixed on the shafts 210 and 220 respectively to thrust into the paper and perform tearing operation. As shown in FIG. 7, the shredding blades 211 and 221 are each formed by a plate-like member with sharp cutting points on both ends thereof, and two plate-like members are fixed on each of the shafts 210 and 220, in such a manner as placing each shaft between the two plate-like members. The two shredding members are kept in pairs placing the shaft therebetween, and multiple pairs are arranged in the axial direction of each of the shafts 210 and 220. These multiple pairs of shredding members are respectively opposed to the multiple lines of belt 231 being arranged in the axial direction of the pulleys 232. In addition, the shredding blades 211 and 221 are fixed in such a manner that rotating diameters of both shredding blades overlap each other, and there is a phase difference of 90 degrees therebetween. Accordingly, the blades are enabled to easily thrust into the paper that passes through both the blades.

The shaft 210 is further equipped with a protrusion-like wheel 213 freely rotatable about the shaft 210 and a roller 214 that is fixed on the protrusion-like wheel 213, between each of the multiple shredding blades 211 in pairs. The roller 214 comes into contact with pressure with the belt 231, thereby catching the paper between the roller 214 and the belt 231 to transport the paper. The protrusion-like wheel 213 is a discoid member that has sharp protrusion-like cutting points on the outer periphery thereof, and arranged between each of the multiple lines of belt. The protrusion-like wheel 213 transports the paper while boring holes in the paper placed between the roller 214 and the belt 231, having a holding power opposing to a large tensile strength generated by the shredding blades against the paper, thereby helping the paper to be shredded up to the end.

An explanation will be made regarding an operation of the shredding part 200 with the configuration as described above. When the paper transported by the press rollers 234 and the belt 231 reaches between the pulley 232*a* and the roller 214, the protrusion-like wheel 213 thrust the cutting points into the paper and transport the paper in between the shredding blades 211 and 221, while surely holding the paper. If the protrusion-like wheel 213 does not exist, the paper tries to go straight, due to its rigidity, in the traveling direction of the paper. However, since the paper is held by the protrusion-like wheel 213, the paper moves along the wheel, and it is possible to forward the paper in between the shredding blades 211 and 221 with reliability. The shredding blades 211 and 221 rotate at a speed higher than the protrusion-like wheel 213 that rotates at the same rotation speed as the pulley 231*a*. Therefore, the shredding blades apply a tearing force to the paper held by the protrusion-like wheel 213, thereby tearing the paper into shreds, and these shreds drop into the hopper 240 that is installed below the shredding blades 211 and 221. The paper is transported by the protrusion-like wheel 213 up to the rear edge at a constant transporting speed, and is torn by the shredding blades up to the end. Therefore, there is no possibility that the edge of the paper is left in a form of straight line, and with only once shredding operation, the paper can be shredded entirely with reliability. The shreds P' collected in the hopper 240 are forwarded to the compression part 300 prepared for the next step.

According to the present exemplary embodiment, there is provided a unit freely rotating about the shaft to hold and transport the paper on one of the shafts of the shredding blades to shred paper, being arranged in such a manner as opposed to each other. Therefore, it is possible to tear the paper effectively by utilizing a difference between a transporting speed and a rotating speed of the shredding blades, and further, shredding can be surely performed until the end of the paper since the points of action of both the shredding and transporting are at almost the same position with respect to the transporting direction of the paper.

FIG. 8 and FIG. 9 each illustrate a second exemplary embodiment of the shredding part that uses the belt transport system and pulleys. The elements in FIG. 8 and FIG. 9 that correspond to the elements in FIG. 6 and FIG. 7 are labeled the same.

This shredding part is provided with, as a shredding mechanism, a pulley 251 that freely rotates about a shaft 250 and a shaft 210 on which a shredding blade 215 is fixed. The pulley 251 is placed in such a manner as being in contact with pressure with the belt 231 of a paper transporting system, and rotates with the rotation of the belt 231, thereby transporting the paper in such a manner as inserting the paper between the belt 231 and the pulley 251. The belt 231 is made up of multiple lines being arranged in the width direction of the paper (axial direction of the pulley), and multiple pulleys 251 are arranged in such a manner as respectively opposed thereto. In addition, holding rings 252 are attached to the shaft 250 alternately with the pulleys 251 in its axial direction.

Structures of the shredding blade 215 and the shaft 210 are the same as the first exemplary embodiment, and two shredding members make a pair and multiple pairs thereof are fixed in the axial direction of the shaft 210. It is to be noted that two protrusion-like cutting points are formed with a predetermined distance therebetween on each of both edges of each shredding blade 215, so that its rotation does not interfere with the holding ring 252. The shaft 210 is connected to a power source not illustrated, and rotates the shredding blades 215 at a circumferential speed higher than the paper transporting speed by the belt 231. Multiple shredding blades 215 in pairs, the lines of belt 231 and the pulleys 251 are alternately arranged, and the holding rings 252 are arranged to be positioned in the center of the shredding blades respectively. Accordingly, the two protrusion-like cutting points on each of the shredding blades are configured so that they do not interfere with the holding rings. In addition, the shredding blade 215 is installed so that a contact area with the paper is displaced to a little lower than a contact center point (maximum pressure point) between the belt 231 and the pulley 251. This configuration cancels an influence from the belt that is holding the paper when the paper is shredded, avoiding a leftover of band-like paper, and the paper is tore in the paper width direction without any restraint, causing no leftovers of unprocessed paper.

An explanation will be made regarding an operation of the shredding part according to the present exemplary embodiment, in the configuration as described above. When the paper P is guided into the contact area between the pulley 251 and the belt 231 by way of the paper guide 237, the paper is inserted between the pulley 251 and the belt 231, held therebetween, and transported in a state being bent in an arc shape, going along a curvature of the pulley 251. When the forefront of the paper comes into the turning radius of the shredding blade 211 that is rotating at a high speed, the sharp tip of the shredding blades thrust the paper, the paper is torn due to a difference in circumferential speed between the shredding blade and the belt 231, and the shredding is started. In this occasion, since the paper is restricted by the holding ring 252 to move in a direction to escape from the shredding blades, the tearing operation by the shredding blades can be carried out with reliability. Furthermore, since the paper is bent in an arc shape and rigidity is maintained to a certain extent, the shredding blades easily thrust the paper, and further, a noise caused by shredding can be reduced.

When the paper toward the end is processed, a strong tensile force from the shredding blade 211 is acting on the paper that has become short in the width, a portion of the paper other than a part where the belt 231 is holding is tore off, and the part caught by the belt 231 remaining at the last, drops from the pulley 251 in a form of small shred.

According to the present exemplary embodiment, the shredding blade to shred the paper is installed immediately after the paper holding part of the transport-use pulley, and the holding ring is provided on the transport-use pulley, which helps shredding by holding the paper when the paper is shredded. With those configurations, it is possible to shred the paper up to the end with reliability, in a similar manner as the first exemplary embodiment.

FIG. 10 illustrates a third exemplary embodiment of the shredding part that uses the belt transport system and pulleys. This exemplary embodiment features that a second pulley 238 is provided, which constitutes the belt transport system coaxially with the shredding blade 215 of the second exemplary embodiment, and shredding blade 216 is mounted instead of the holding ring 252 that is provided coaxially with the pulley 251. In other words, multiple pulleys 238 each having a radius smaller than the turning radius of the shredding blade 215 are mounted in such a manner as freely rotatable, alternately with the shredding blades 215 on the shaft 210 to which the shredding blades 215 are fixed. Multiple pulleys 238 respectively come into contact with the lines of belt 231 of the transport system, and rotate along with the rotation of the belt 231. On the other hand, similar to the second exemplary embodiment, multiple pulleys 251 are arranged along the axial direction, and the shredding blades 216 each having the same structure as the shredding blade 215 are respectively fixed between each of the pulleys. The pulley 251 is freely rotatable about the shaft 250, and rotates along with the rotation of the belt 231.

In the configuration as described above, firstly, the paper is transported at the speed of the belt 231 in the state of being caught between the pulley 251 and the belt 231 and held therebetween. When the paper goes to some extent over a center position where the pulley 251 and the belt 231 being in contact, the paper starts coming into contact with the shredding blade 215, and tearing operation begins, which is caused by a difference between the transport speed by the belt and the circumferential speed of the shredding blade 215. In the meantime, since the turning diameter of the shredding blade 216 is a little bit smaller than that of the pulley 251, the shredding blade 216 by itself is not capable of contacting the paper. However, once shredding is started by the shredding blade 215, the shredding blade 216 operates in such a manner as shredding the paper that has been pushed toward the shredding blade 216 side, and pushing back the paper toward the shredding blade 215 side to help shredding by the shredding blade 215.

Also in this exemplary embodiment, shredding is performed in the state in which the paper is surely held by the pulley 251 and the belt 231 up to the end of the paper. Therefore, shredding can be carried out by only once shredding operation without leaving the end of the paper.

SECOND EXAMPLE

Exemplary embodiments of the shredding part that utilizes a gear will be explained. FIGS. 11, 12, 13 and 14 illustrate the fourth exemplary embodiment and its modifications utilizing multiple gears. The shredding part according to the present exemplary embodiment simplifies a power source by using multiple groups of gears, and a point of action of the shredding system is moved a little backward with respect to the paper transport system. Accordingly, a shredding tensile force applied to the paper is stabilized and shredding the paper up to the end thereof can be performed with reliability. By using gears for the paper transport system, the paper proceeding to the shredding system is wrinkled in advance. Therefore, the shredding blade easily catches the paper and tearing operation is facilitated.

FIG. 11 and FIG. 12 are respectively a side view and a top view of the shredding part according to the fourth exemplary embodiment. This shredding part 500 includes a first gear-like wheel and a second gear-like wheel 511 and 512 serving as a paper transport system, gear shafts 521 and 522 serving as a shredding system, and shredding blades 531 and 532 respectively fixed on the gear shafts 521 and 522. As shown in FIG. 12, multiple gear-like wheels 511 and 512, and multiple shredding blades 531 and 532 are arranged in the width direction of the paper, and the gear-like wheels and the shredding blades are alternately arranged, when viewed from the direction of the arrow as shown in FIG. 11.

The gear-like wheels 511 and 512 are the same in shape, and are ring-shaped member having outer teeth 512*a* on the outer periphery and inner teeth 512*b* in the inner periphery. The outer teeth on both members are engaged with each other, and the gear shafts 521 and 522 respectively engage with the inner teeth. Shredding blades 531 and 532 each having the same structure as the first exemplary embodiment are respectively fixed on the periphery of the gear shafts 521 and 522, in such a manner that each of the shredding blades 531 and 532 is made up of two members in pair and multiple pairs are fixed with a space therebetween. On the outer peripheries of the gear shafts 521 and 522, where the shredding blades are not fixed, there are formed teeth to engage with the gear-like wheels 511 and 521 respectively. The gear shafts 521 and 522 are connected to a driving force not illustrated, and the gear shaft 521 turns in a clockwise and the gear shaft 522 turns in a counterclockwise. According to the turning of the gear shafts 521 and 522, the shredding blades 531 and 532 respectively fixed on these gear shafts are rotated. The turning radius of the shredding blade 531 overlaps the turning diameter of the shredding blade 532, and accordingly, the paper passes therebetween is shredded. A place where the outer teeth of the gear-like wheels 511 and 512 are engaged with each other is set to be a position displaced a little upward (approximately 1 to 2 cm above) from the rotating centers of the shredding blades.

According to the turning of the gear shafts 521 and 522, the gear-like wheels 511 and 512 having inner teeth respectively engaged with those gear shafts are rotated in the same direction as the gear shafts. The rotation speed of the gear-like wheels 511 and 512 is a slow rate that is obtained by decelerating the rotation speed of the gear shafts 521 and 522, based on a speed reduction ratio that is determined by a ratio between the number of teeth of the gear shaft and the number of the inner teeth. For instance, a rotation speed ratio between the shredding blade and the gear-like wheel is configured such that one rotation of the shredding blade allows the gear-like wheels to transport the paper by approximately 4 cm, and the cutting points of the shredding blades alternately hit the paper every 1 cm transporting of the paper. With the configuration above, a speed difference is generated between the gear-like wheels 511 and 512 serving as the transport system, and the gear shafts 521 and 522 serving as the shredding system, enabling a tearing operation by the shredding blades.

Furthermore, in order to stabilize the rotation of the wheels, gears 541 and 542 are respectively provided on the inner side of the gear-like wheels 511 and 512, being positioned not to interfere with the rotation of the shredding blades fixed on the gear shafts.

In the configuration above, paper that is transported from the transport system (paper feeder) not illustrated goes along the guide 550 and forwarded in between the gear-like wheels 511 and 512 is firstly caught by the outer teeth and deformed into a wrinkled shape, and immediately thereafter, the paper is shredded by the shredding blades 531 and 532. Since the shredding blades 531 and 532 are rotating at a higher circumferential speed relative to the speed at which the gear-like wheels 511 and 512 transport the paper, a tensile force is given to the paper, whereby a stable tearing operation is carried out and shredding is performed up to the end of the paper.

According to the present exemplary embodiment, since the gears of the transport system to transport the paper and the shafts of the shredding system to shred the paper are each in a form of planetary gear, it is possible to perform the transporting and the shredding in an identical drive system, and it is further possible to place the point of action of the shredding system successively from the point of action of the transport system, thereby allowing the paper to be shredded up to the end with reliability. Further, since the paper is made wrinkled by the transport system, facilitating a thrust by the shredding blades into the paper, and an efficient shredding can be performed.

As for the shredding part utilizing a group of gears, a combination of the gears may be modified variously, in addition to the above exemplary embodiment. As shown in FIG. 13, for instance, gears 571 and 572 used for power transmission, being engaged with the outer teeth, respectively, may be provided outside of the gear-like wheels 561 and 562, thereby separating the driving of the gear-like wheels 561 and 562 from the driving of the shredding blades. In the present exemplary embodiment, the gear-like wheels 561 and 562 are rotatably supported by the holders 581 and 582 that are thicker than those wheels. Each of the holders 581 and 582 are supported by two columns 590. The shafts 511 and 512, on which the shredding blades are fixed, are rotatably supported by the holders and rotated at a circumferential speed higher than the gear-like wheels 561 and 562.

Also in the present exemplary embodiment, the point of action of the gear-like wheels and the point of action of the shredding blades are close to each other, and the paper can be fed into the shredding blades in the state being wrinkled by the gear-like wheels. Therefore, similar to the embodiment as shown in FIG. 11, shredding of the paper can be performed surely and efficiently.

A modified example as shown in FIG. 14 illustrates a shaft 600 on which shredding blades are fixed, gears 610 fixed on the shaft alternately with the shredding blades, gears 620 that engage with the gears 610, and gears 630 that rotate coaxially with the gears 620, and the rotation of the shaft 600 is decelerated and transferred to the gear wheels 640. The shaft 600 on which the shredding blades and the gears 610 are fixed, and the shaft 650 on which the gears 620 and the gears 630 are fixed are supported by the base 660 that is made of oil containing alloy and the like. The base 660 serves as a bearing for the shaft 670 of the gear-like wheel 640. The gear 610 and the gear 630 are positioned on the same side of the base 660, and separated from other members.

Also in the present exemplary embodiment, the point of action of the gear-like wheels and the point of action of the shredding blades are close to each other, and the paper is fed into the shredding blades in the state being wrinkled by the gear-like wheels. Therefore, similar to the embodiment as shown in FIG. 11, shredding of the paper can be performed surely and efficiently.

Next, another exemplary embodiment of the shredding part will be explained, which utilizes gears, and the point of action of the transporting system and the point of action of the shredding system are located substantially at the same position with respect to the paper transporting direction, and enabling an efficient paper shredding with the smaller number of gears rather than the second exemplary embodiment.

FIG. 15 and FIG. 16 illustrate the fifth exemplary embodiment of the shredding part 700. FIG. 15 is a side view of the paper transporting direction, and FIG. 16 is a top view thereof. This shredding part is provided with two parallel drive shafts 710 and 720, a transport-use gear 711 fixed on the drive shaft 710, and a shredding-use gear 721 fixed on the drive shaft 720, a driven gear 713 that is rotatably supported by the drive shaft 710 and follows the shredding-use gear 721 by being engaged therewith, and a driven gear 723 that is rotatably supported by the drive shaft 720 and follows the transport-use gear 711 by being engaged therewith. The transport-use gear 711 has a tooth width smaller than the other gears, in order to concentrate a tensile force for the paper P thereon and to facilitate tearing therefrom.

The drive shafts 710 and 720 are respectively connected to driving sources not illustrated, and rotated at different speeds. The drive shaft 720 on which the shredding-use gear 721 is fixed rotates at a speed higher than the drive shaft 710 on which the transport-use gear 711 is fixed. More than one transport-use gears and driven gears are alternately arranged on one drive shaft, and more than one transport-use gears or shredding-use gears and driven gears are alternately arranged on each drive shaft, in such a manner that the transport-use gears 711 fixed on the drive shaft 710 are engaged with the driven gears 723 fixed on the drive shaft 720, and the shredding-use gears 721 fixed on the drive shaft 720 are engaged with the driven gears 713 fixed on the drive shaft 710, respectively.

Load springs 731, 732 are mounted between each of the gears. The load springs 731 and 732 have a purpose to provide a rotation load torque that is appropriate for the freely rotatable driven gears 713 and 723. This rotation load torque increases a pressure for holding the paper at a portion where the two gears are engaged and in contact with each other, thereby enhancing a holding force and a transporting force against the paper being caught in between the transport-use gear and the shredding-use gear.

In the configuration as described above, when the paper P reaches the position where the transport-use gear 711 and the driven gear 723 are engaged, the paper is caught into the two gears, and transported in the state being wrinkled. Simultaneously, transporting of the paper is started also between the shredding-use gear 721 and the driven gear 713. On this occasion, since the transporting speed by the shredding-use gear 721 is higher than the transporting speed by the transport-use gear 711, a partial and large pulling force is generated on the paper between the both gears, and a tensile force is concentrated on the paper holding part of the transport-use gear. Consequently, the paper is tore from the part, shredded, and becomes fine shreds.

As thus described, according to the present exemplary embodiment, it is possible to provide an ensured paper holding force and shredding force with a simple configuration including two drive shafts, equipped with a combination of a transport-use gear and a driven gear, and a combination of a shredding-use gear and a driven gear, thereby enabling a reliable and efficient shredding up to the end of the paper.

FIG. 17 and FIG. 18 illustrate a sixth exemplary embodiment, which is a modified example of the present embodiment. This exemplary embodiment is the same as the fifth exemplary embodiment in the point that a transport-use gear 711 and a shredding-use gear 721 are respectively fixed on two drive shafts 710 and 720 having a rotating direction and rotating speed different from each other. However, a driven gear constituting the transport system being engaged with the transport-use gear 711 is not fixed on the drive shaft 720. Instead, a press gear 740 is mounted at a position different from the point of action of the shredding system, i.e., above the transport-use gear 711 in this example here. The press gear 740 has relatively wide gear teeth. As for the transport-use gear 711, a coefficient of shift is adjusted in the manufacturing process, so that the tooth top is processed to be sharply pointed. In addition, the transport-use gear 711 has a diameter larger than the driven gear 713, and it protrudes toward the shredding-use gear 721 side, rather than the center of the engagement position between the shredding-use gear 721 and the driven gear 713.

In the configuration above, when the paper is caught in between the transport-use gear 711 and the press gear 740, the paper is forcefully pressed toward the transport-use gear 711 side, then, the paper being thrust by the teeth of the transport-use gear and transported with holes being made, and the paper is forwarded in between the shredding gear 721 and the driven gear 713. When the forefront of the paper is caught into the engagement part between the shredding gear 721 and the driven gear 713, the paper is forwarded at a speed higher than transporting speed of the transport-use gear 711, while firmly held under pressure between the teeth. Therefore, a large tearing force is generated between the transport-use gear 711 and the shredding-use gear 721. On this occasion, the teeth of the shredding-use gear 721 are positioned at a location protruding toward the shaft 710 side on which the transport-use gear 711 is fixed, rather than the location of the teeth of the transport-use gear 711, whereby tearing and shredding are performed more smoothly. In addition, since the paper which has holes already made by being thrust by the press gear 740 and the transport-use gear 711, the entire tensile force applied to the paper is concentrated on these holes. Therefore, tearing the paper can be started only with a relatively weak tensile force and the paper is shredded into fine shreds.

FIG. 19 illustrates an overall structure of a document shredder in which the shredding part according to the sixth exemplary embodiment is connected to a paper feeder 100 provided with a belt transport system. When a conveyor belt 131 is rotated, paper P held in the paper storage is forwarded out of the paper storage 110, through a space between the paper storage 110 and the conveyor belt 131, and the separation roller 121 separates, for example, only one sheet of paper. Then, the paper is guided by the guide roller 139 and the guide 135, to be carried to the transport-use gear of the shredding part 700. The paper is thrust and transported by teeth of the transport-use gear 711 at an engagement part with the press gear 740. Then, the guide 135 guides the paper to an engagement part with the shredding-use gear 721 being rotating. Since the shredding-use gear 721 has a transport speed higher than the transport-use gear 711, a force to tear the paper is generated between those gears. Then, the paper is shredded finely, and collected into a compression part via the hopper.

Next, an explanation will be made with regard to the compression part 300. The compression part 300 packs the shreds 312 generated by the shredding part 200 with a given compressing force, and ejects one piece of compressed object.

Firstly, a structure of the compression part 300 will be explained with reference to FIG. 20 that illustrates a top view, FIG. 21 that illustrates a cross sectional view taken along the line A-A, and FIG. 22 that illustrates a side view. The compression part 300 includes a storage part 307 into which the shred 312 is inputted from above, a compression room 304 that is connected to the storage part, and a compression mechanism part 331 that is placed between the storage part 307 and the compression room 304. In order to show an internal structure, FIG. 20 illustrates a partially sectional view of the compression room 304 and the compression mechanism part 331.

An outside shape of the storage part 307 is illustrated by a dashed line in FIG. 21, and the storage part 307 is made up of a main unit formed by curving a plate-like member into U-shape, and a side surface member being a plate-like member that is placed on one edge of the main unit. Opening of the U-shaped main unit is facing upward as an input port for the shreds 12. The other side surface of the U-shaped main unit part, being opened, is connected to the compression mechanism part 331.

The compression room 304 includes a tubular shaped compression room main body, made up of a combination of four plate-like members, and two pieces of compression walls 309. The tubular shaped compression room main body has an internal space, whose cross section is a shape of quadrangle, and the diameter of the space is constant in the axial direction without any part being narrowed. Therefore, the shreds 312 being compressed are not pushed against a specific portion in the axial direction of the compression room main body having the tubular shape. One side of the opening of the tubular-shaped compression room main body serves as an inlet port of the shreds, and the other side serves as an outlet port.

The two pieces of plate-like compression walls 309 are arranged, in such a manner that one end of one wall and one end of the other wall butt against one another with inclines being tapered, i.e., an angle made by the principal planes is rendered to be less than 180 degrees, so that the compression walls cover the outlet port of the tubular shaped compression room main body. The other ends are respectively attached to the side surfaces of the tubular shaped main body, via hinges 321. With this configuration, the compression walls 309 cover the opening of the compression room main body in such a manner as openable and closable like a set of double doors. On the ends of the two compression walls 309 being butted, there are respectively provided projections 322, and an end of the spring 310 is fixed each of the projections 322. Another end of the spring 310 is fixed to a projection 323 that is provided on the each side of the compression room main body. In this occasion, the springs 310 are attached in such a manner as applying a force toward the direction to close the two compression walls 309. The shreds 312 inside the compression room 304 are pressed against the compression walls 309, whereby they are compressed. If a force by a block made of shreds 312 (paper block 311) to push the compression walls 309 from inside goes over a force applied by the springs 310 in the direction to close the compression walls 309, the paper block 311 pushes the compression walls 309 to open, and the paper block 311 is ejected to the outside.

The compression mechanism part 331 is provided with a frame 313 that is placed in such a manner as connecting the storage part 307 with the inlet port of the compression room 304, a shaft 302 that is rotatably placed within the internal space of the connection part between the storage part 307 and the compression room 304, a compression roller 301, a drive shaft 306, and a coil spring 305.

The shaft 302 is inserted in the center of rotation of multiple compression rollers 301, so as to support the compression rollers 301 to rotate about the shaft 302. Furthermore, a drive shaft 306 is inserted perpendicularly in the center of the shaft 302. The opposite end of the drive shaft 306 penetrates in the storage part 307, and projects from the reverse side surface, so as to be connected to a rotary driving source, not illustrated. With a rotary driving by the drive shaft 306, the shaft 302 rotates within a boundary surface (vertical plane) between the storage part 307 and the compression room 304. Accordingly, the compression rollers 301 rotate in such a manner as drawing a concentric circle about the drive shaft 306 in the boundary surface between the storage part 307 and the compression room 304. In this occasion, if the compression room 304 is full of shreds 312, the compression rollers 301 compress the shreds 312, by rotating on its shaft 302 in such a manner as squeezing the end face of a block made of the shreds 312.

Both ends of the shaft 302 are respectively fixed on ring-shaped supporting member 303 that is placed inside the frame 313. The supporting member 303 is firmly supported by the frame 313 via a thrust bearing 308. Therefore, even when a degree of compression for the shreds 312 within the compression room 304 is increased, and a large pressure is applied onto the compression rollers 301, the frame 313 is able to support a reaction force worked on the supporting member 303 by way of the bearing 308 that is capable of receiving a radial load and a thrust load. With the configuration above, even when a large compressive force occurs, the compression rollers 301 are allowed to rotate stably. In addition, the frame 313 is surely able to support a large force applied on the shaft 302, thereby allowing a rotary driving with a low torque.

The coil spring 305 is a spiral transport mechanism with an appropriate setting of feed pitch, being placed within the internal space of the storage part 307. Both ends of the spring coil are fixed on the drive shaft 306. According to the rotation of the drive shaft 306, the coil spring 305 is also rotated in the internal space of the storage part 307, and operates as a transporting mechanism to move the shreds accumulated in the storage part 307 to the compression room 304 side.

Next, an operation of the compression part 300 will be explained. The shreds 312 generated by the paper shredding part 200 are continuously inputted from the upper opening of the storage part 307. In the state above, when the drive shaft 306 is rotated, the coil spring 305 continuously transports the shreds 312 accumulated in the storage part 307 toward the compression room 304. The shreds 312 pass through the space beside the rotating shaft 302, and they are transported into the internal space of the compression room 304. When the compression room 304 becomes full of the shreds 312 up to the boundary surface between the compression room 304 and the storage part 307, the compression rollers 301 mounted on the shaft 302 being rotating on the boundary surface, are rotated in circular orbit in the state of being contact with the end face of the block made of the shreds 12. Accordingly, the shreds 312 are continuously squeezed and compressed into the compression room 304. The shreds 312 further continuously transported from the storage part 307 are squeezed by the compression rollers 301, and pushed into the compression room 304 in such a manner just like hardened by foot. As thus described, the transporting by the coil spring 305 and the compressive operation by the compression rollers 301 proceed continuously by the rotation of the drive shaft 306, and compression of the shreds is also carried out continuously inside the compression room 304, resulting in that the shreds 312 are changed to a paper block 311.

When the pressure that pushes the pressure walls 300 by the paper block 311 in the compression room 304 reaches a predetermined level set by a spring force of the spring 310, the paper block 311 presses and opens the pressure walls 309, and the paper block 311 rendered one piece after compressed is ejected from the compression room 304, keeping the form of one piece. As thus described, the compression part 300 according to the present exemplary embodiment is configured such that a diameter of the tubular shaped main body of the compression room 304 is set to be constant, and a point where the largest force is applied by compressing the shreds 312 in the compression room 304 is directed to the pressure walls 309 on the tip (outlet port). In addition, these pressure walls 309 are structured to be openable and closable by a force of the spring, and the outlet port is opened by a given pressure. Therefore, in the structure according to the present exemplary embodiment, it is possible to prevent an occurrence of jamming of the paper block 311 made of the compressed shreds. Furthermore, if a spring having a desired spring force is employed as the spring 310, a compression force against the paper block 311 can be easily set to be a desired force. A ratio of the compression can also be adjusted by changing the inclination of the butting between the two pressure walls 309.

In addition, the main body of the compression room 304 keeps a constant diameter until the paper block 311 abuts against the pressure walls 309 with pressure, tapering part or the like to narrow the diameter gradually is not necessary, thereby downsizing the compression room 304. Since the compression mechanism part 331 has a configuration that the compression rollers 301 are brought into contact with the end face of the paper block 311, and perform squeezing by rotating on the end face, the compression mechanism part 331 is only required to have a space corresponding to a thickness of the rollers 301, thereby achieving a small-sized compression mechanism part 331.

In addition, as a transport mechanism in the compression mechanism part 331, the coil spring 305 is employed, and it is rotated by the drive shaft 306 that penetrates into the storage part 307. Therefore, the shreds can be transported by the use of the rotating drive shaft of the compression mechanism part 331, without preparing a separate transport mechanism. In addition, as described above, the transport by the coil spring 305 and the compression by the compression rollers 301 can be performed even in the case where the plane of the paper block 311 to be compressed is set to be along the vertical direction. In the case where the compression plane is set to be along the vertical direction, the transporting and compression can be carried out. Therefore, it is possible to provide a compression part 300 that has a lot of flexibility in orientation of installation.

It is to be noted that the coil spring 305 for transporting the shreds can be expanded from being one thread to two or more threads as appropriate. In the above structure, the pressure walls 309 of the compression room 304 are closed according to the pulling force by the spring 310, but the compression part 300 according to the present exemplary embodiment is not limited to this structure. For example, it is further possible that a spring is placed between the pressure walls 309 and an enclosure not illustrated, and the pressure walls 309 are closed by applying a force to vertically push the outside surfaces of the pressure walls 309. In the configuration above, the paper block 311 pushes and opens the pressure walls 309 to be ejected therefrom, by opposing a force retracting the spring. Therefore, this configuration is suitable for a case that it is required to compress the paper block 311 with a large compressing force, or the like.

In the compression part 300 as described above, the compression mechanism part 331 compresses the paper block 311 by using the compression rollers 301 and the shaft 302, but another mechanism may be available for use. For example, as shown in FIG. 23, a propeller 344 mounted on the drive shaft 306 may compress the paper block 311. When the propeller 344 is rotated, a surface of the propeller 344 on the compression room 304 side is brought into contact with the end face of the paper block 311, and slides on the end face. With this sliding, the paper block 311 is squeezed and compressed.

In the occasion above, it is possible to provide multiple grooves concentrically about a rotation center of the propeller 344, on the compression room 304 side of the propeller 344. With this configuration, it is possible to reduce a dynamic friction between the propeller 344 and the paper block 311, thereby reducing the rotation torque of the drive shaft 306.

EXPLANATIONS OF REFERENCE NUMERALS

Figure 1:
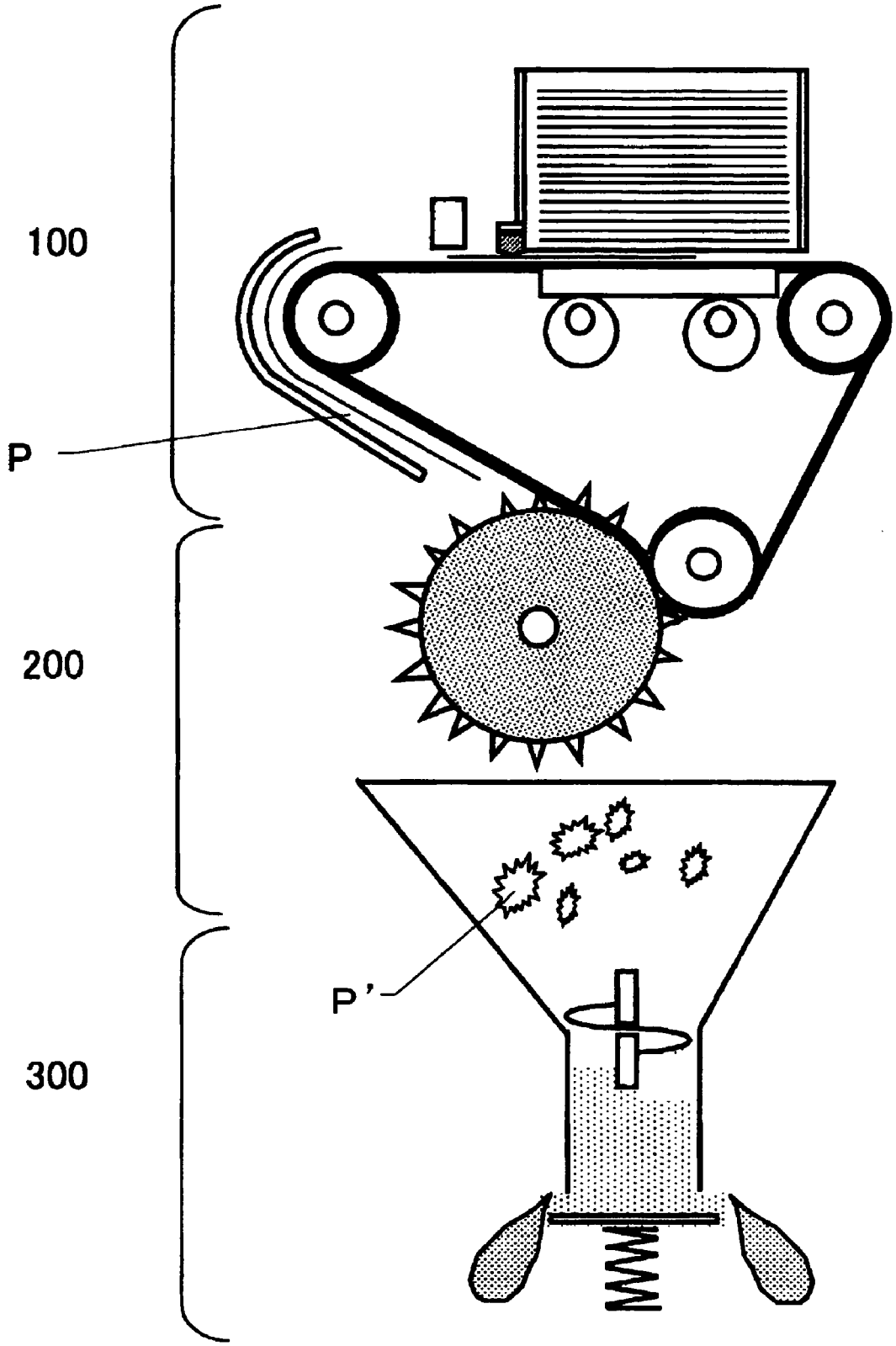
FIG. 1 illustrates an overall structure of a document shredder according to an aspect of the present invention.
Figure 2:
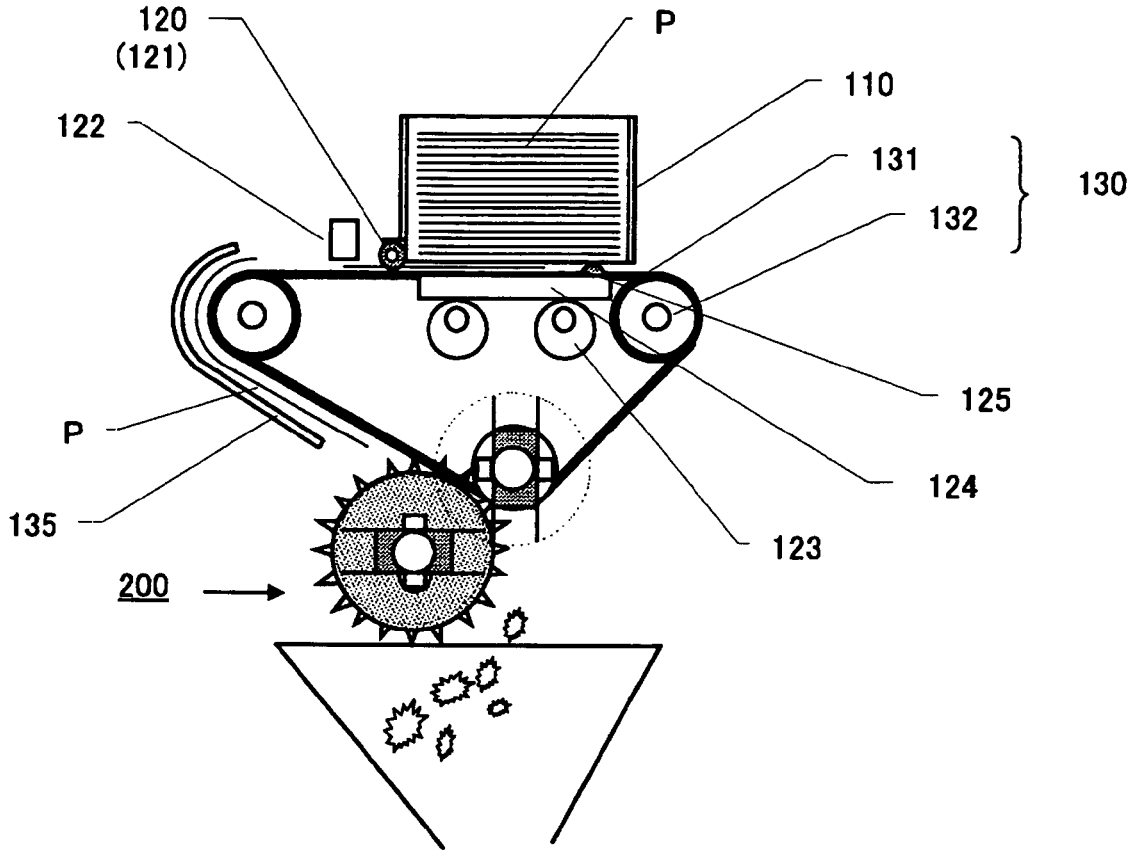
FIG. 2 illustrates one embodiment of a paper feeder.
Figure 3:
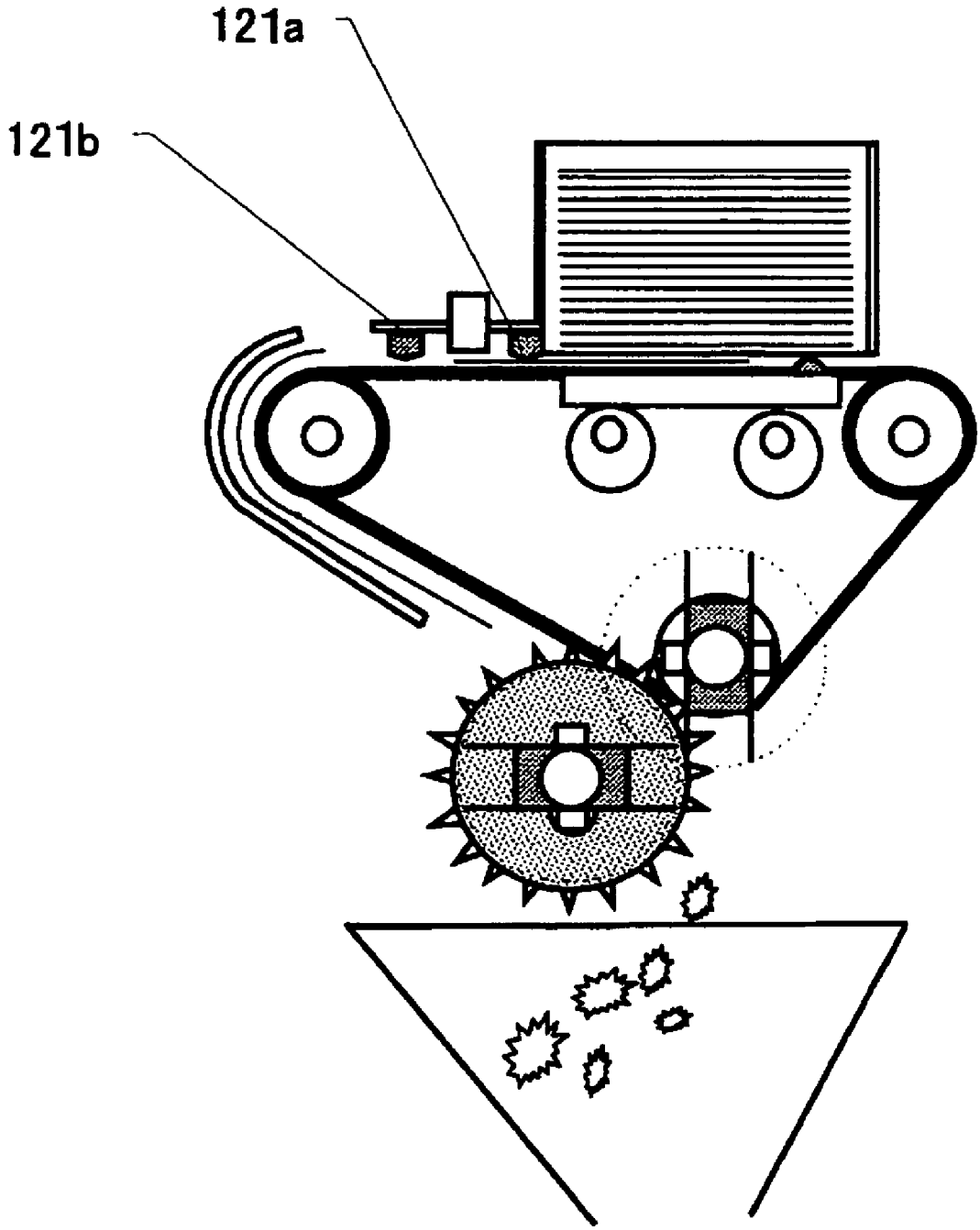
FIG. 3 illustrates another embodiment of the paper feeder.
Figure 4:
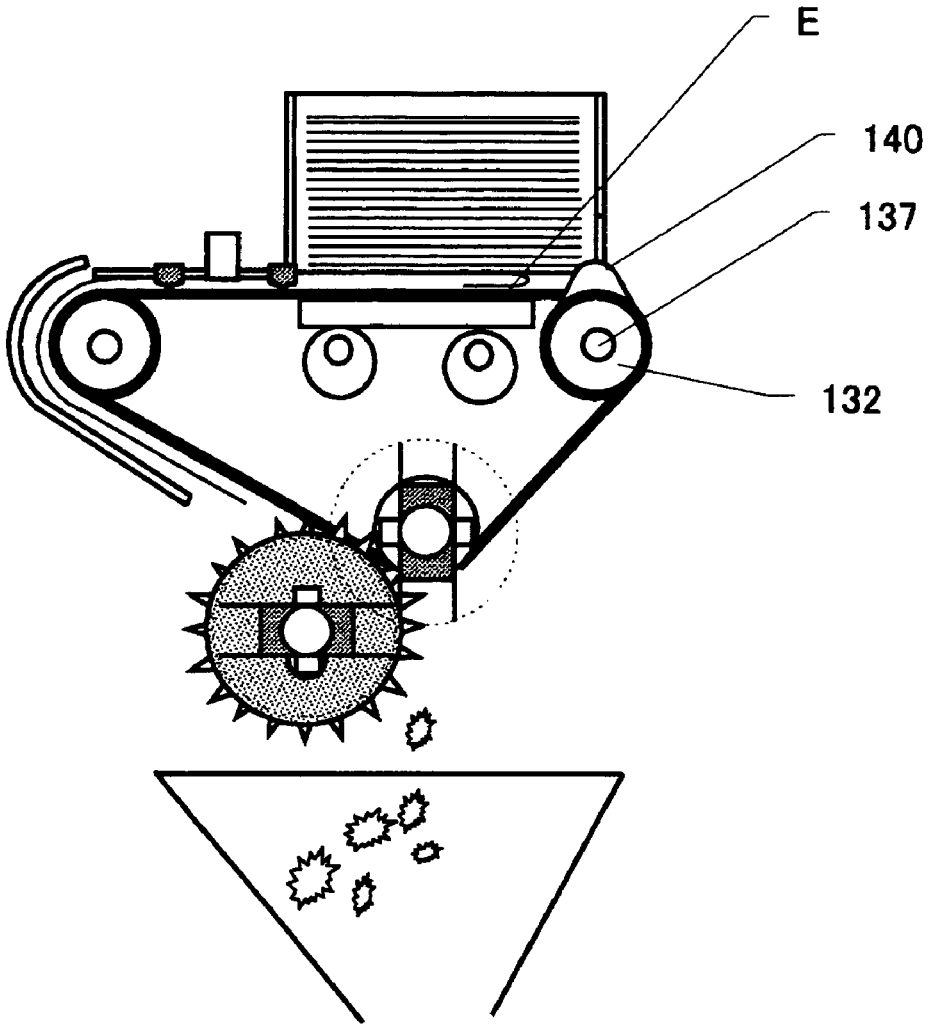
FIG. 4 illustrates alternative embodiment of the paper feeder.
Figure 5:
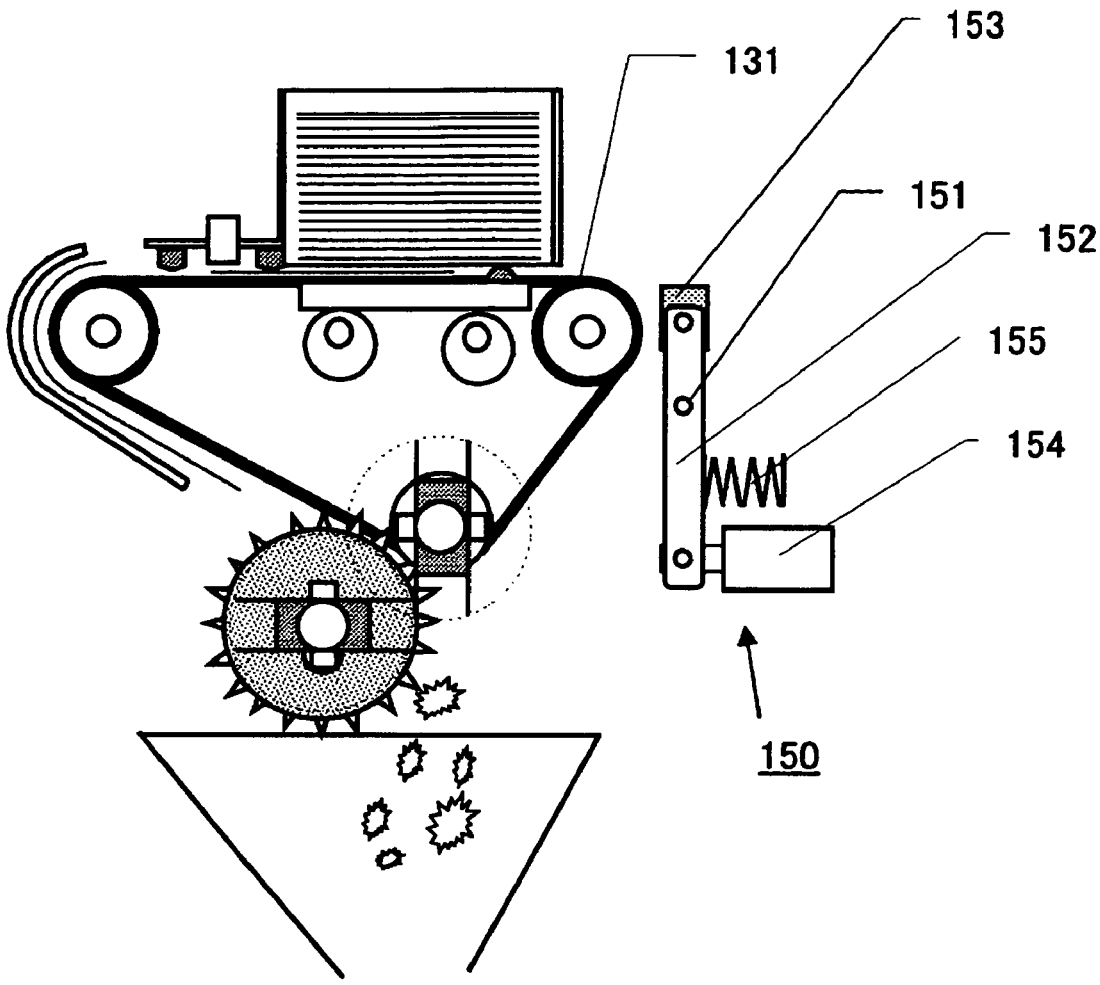
FIG. 5 illustrates further alternative embodiment of the paper feeder.
Figure 6:
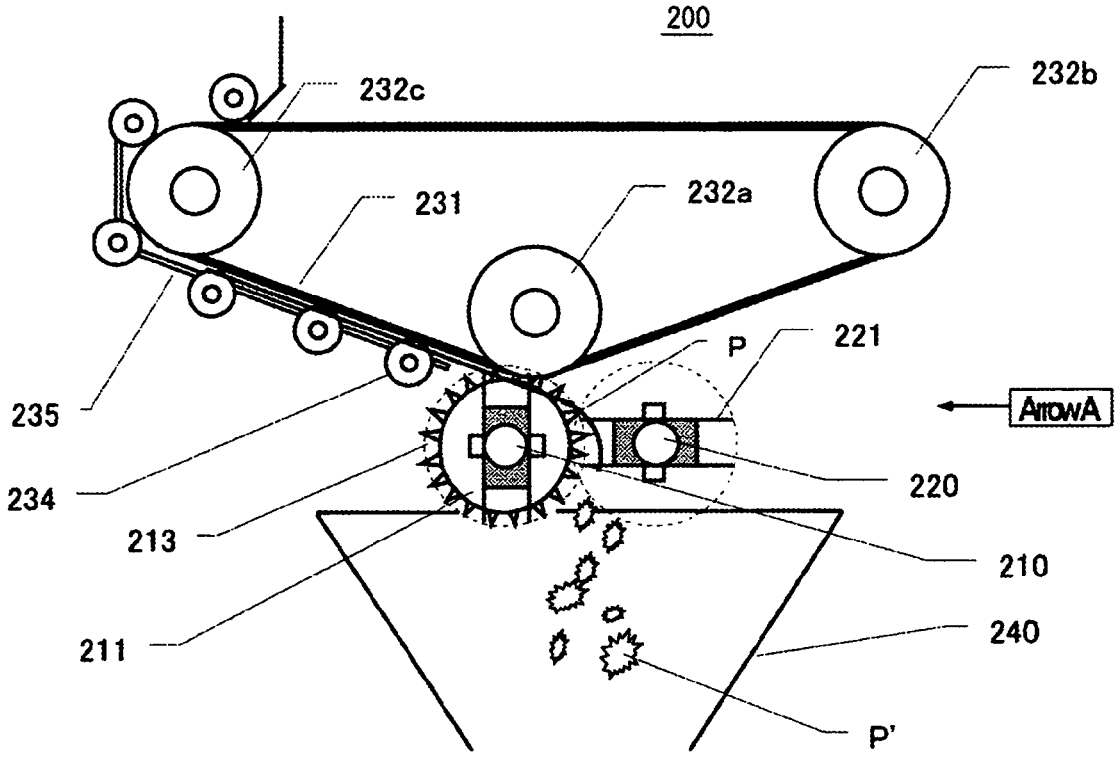
FIG. 6 is a side view of a shredding part according to the first embodiment.
Figure 7:
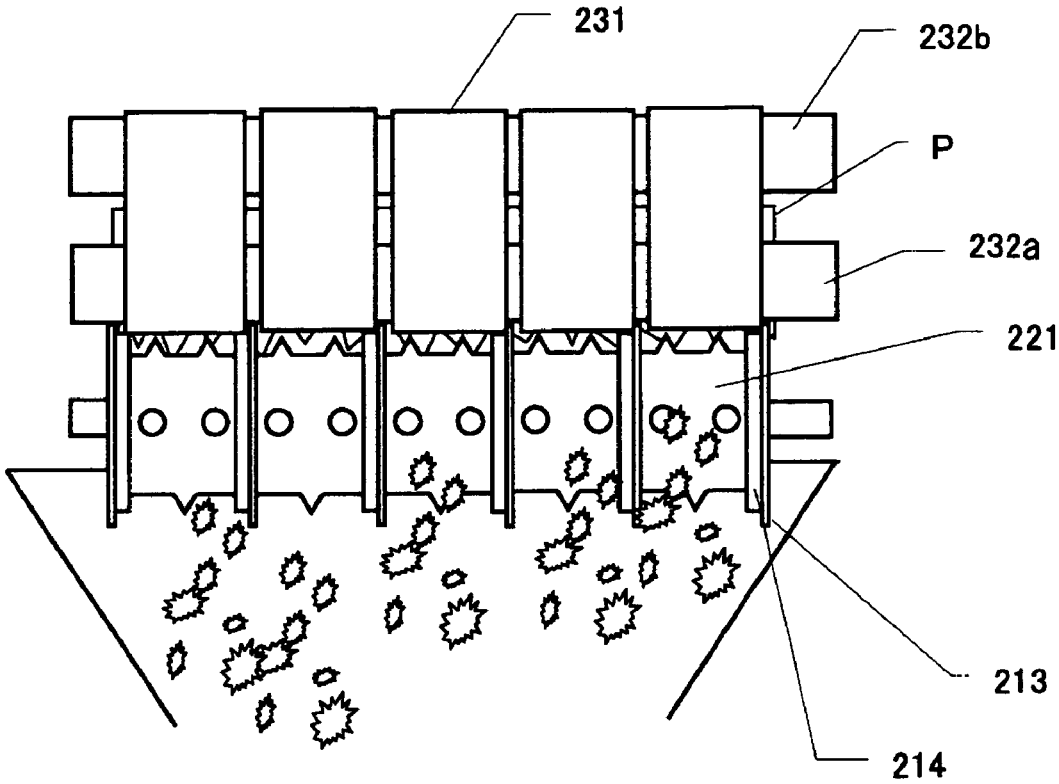
FIG. 7 is an illustration of the shredding part as shown in FIG. 6, viewed from arrow A.
Figure 8:
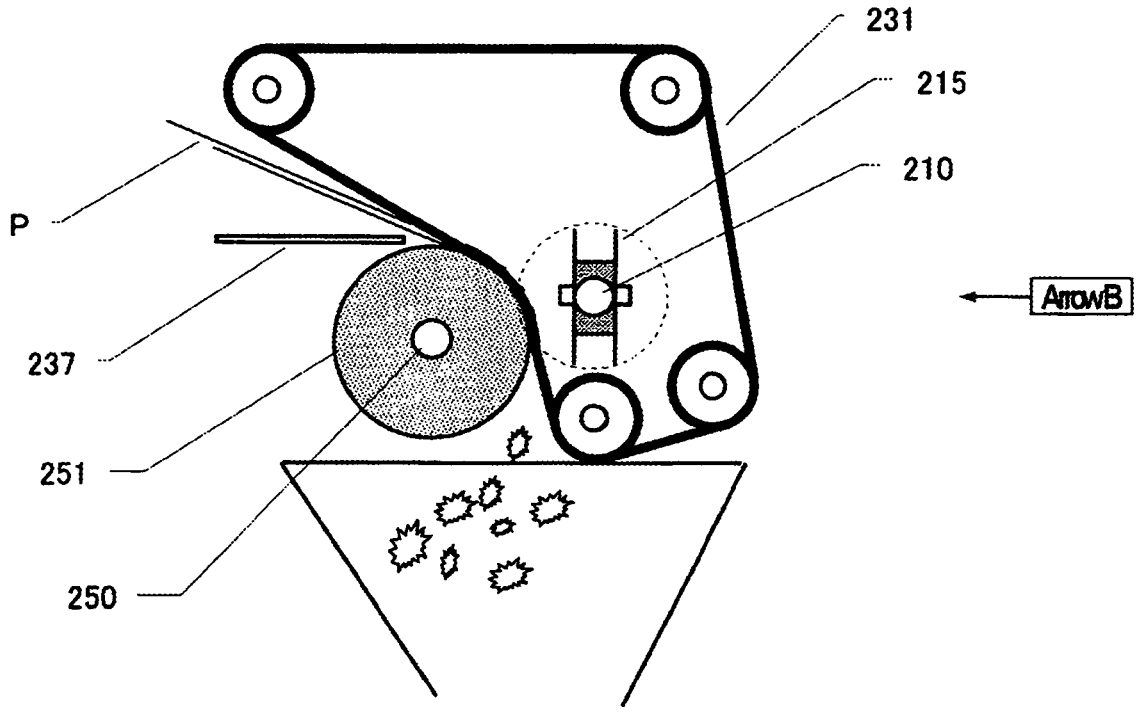
FIG. 8 is a side view of the shredding part according to the second embodiment.
Figure 9:
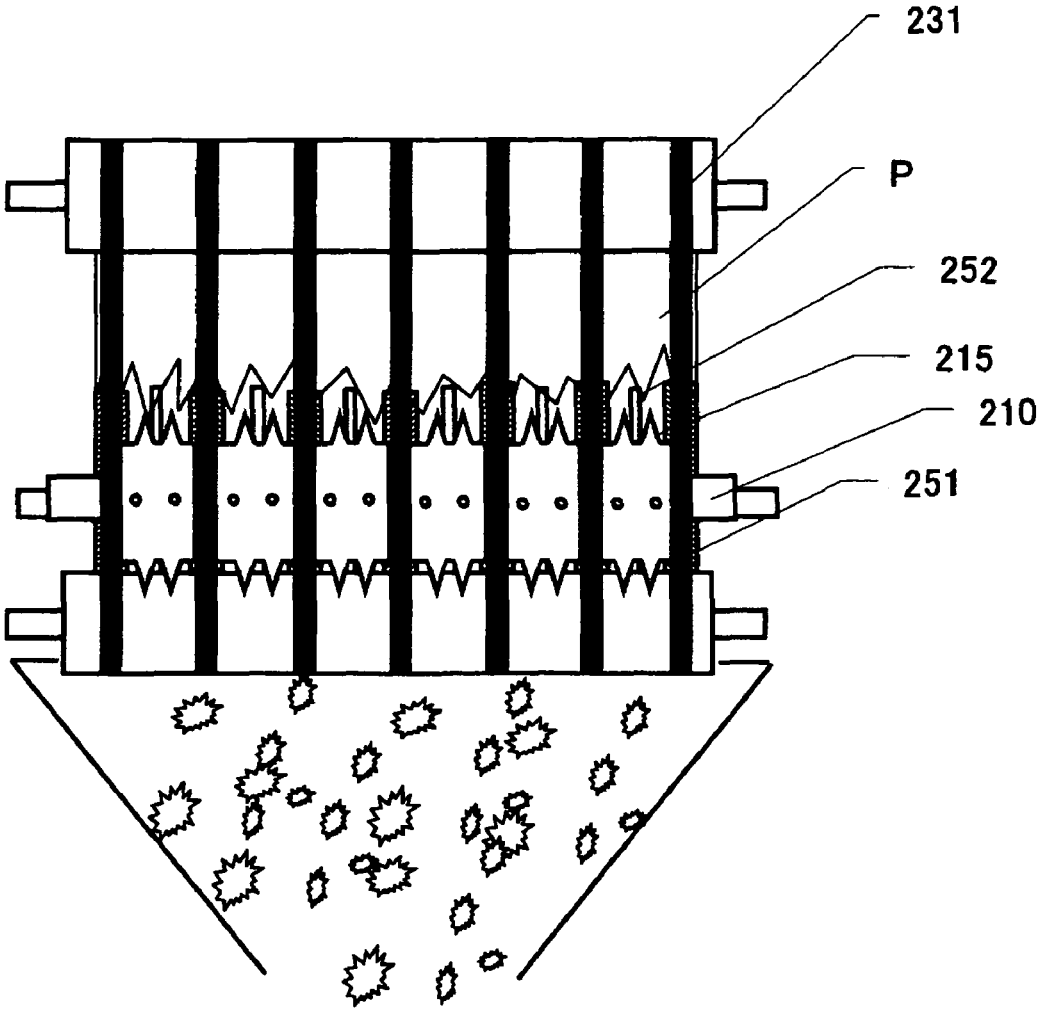
FIG. 9 is an illustration of the shredding part as shown in FIG. 8, viewed from arrow A.
Figure 10:
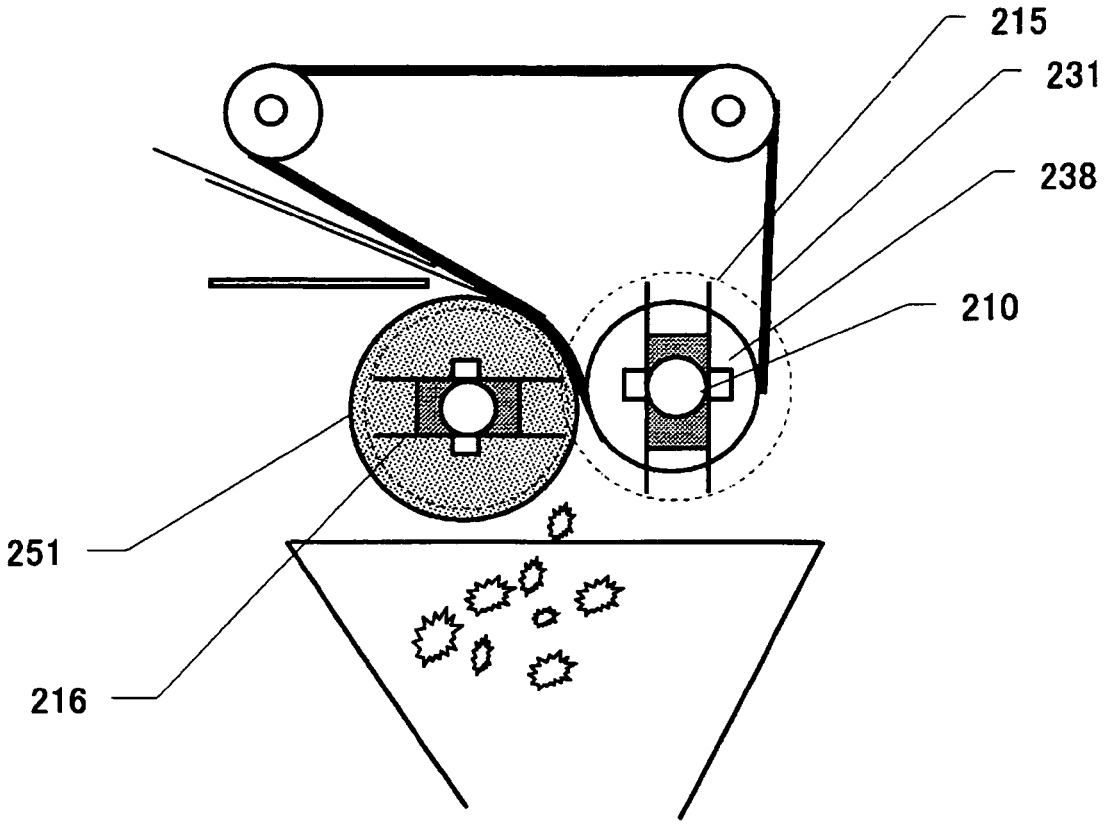
FIG. 10 is a side view of the shredding part according to the third embodiment.
Figure 11:
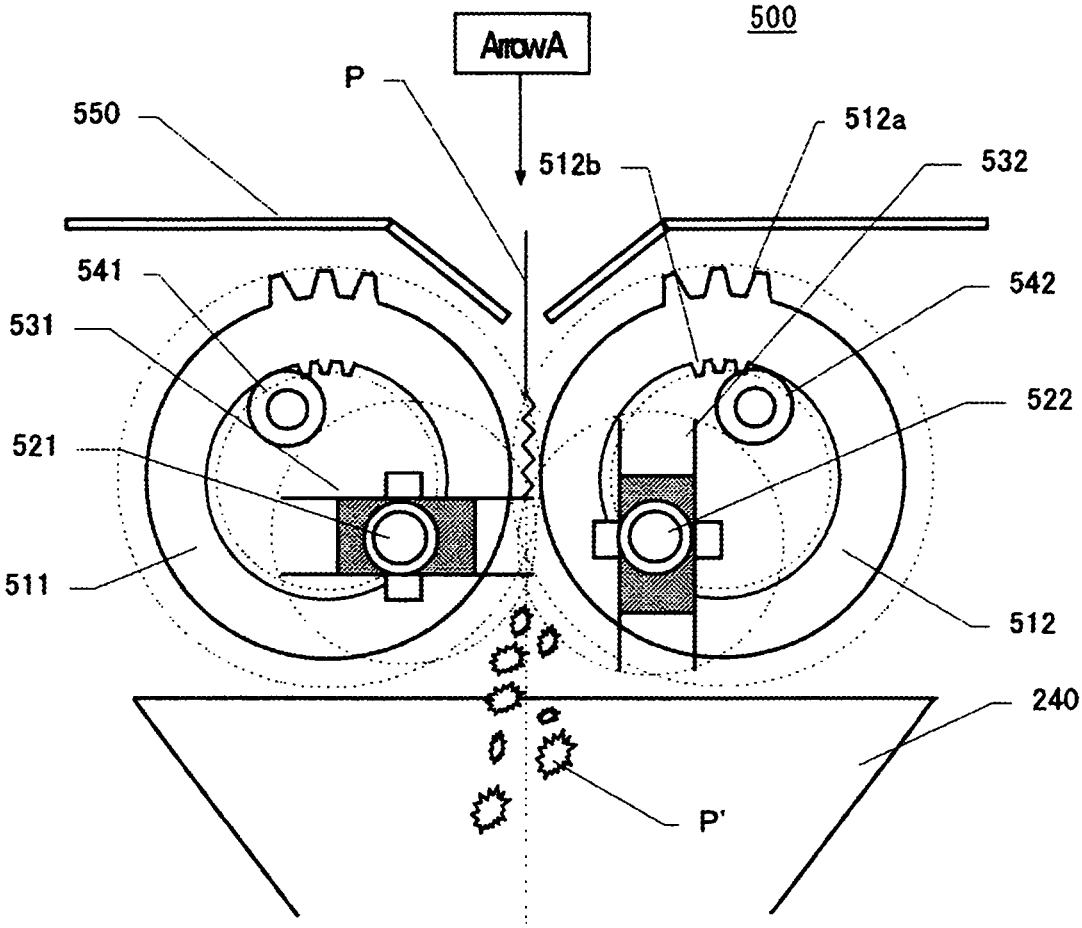
FIG. 11 is a side view of the shredding part according to the fourth embodiment.
Figure 12:
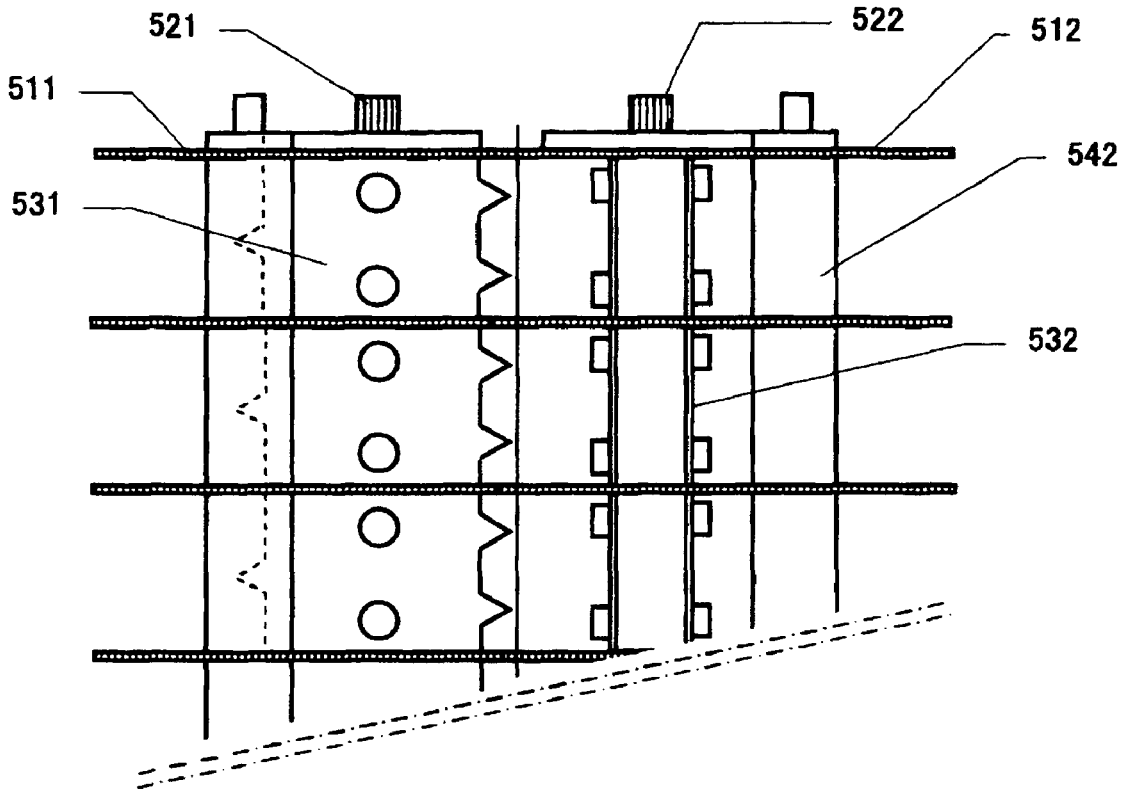
FIG. 12 is an illustration of the shredding part as shown in FIG. 11, viewed from the top.
Figure 13:
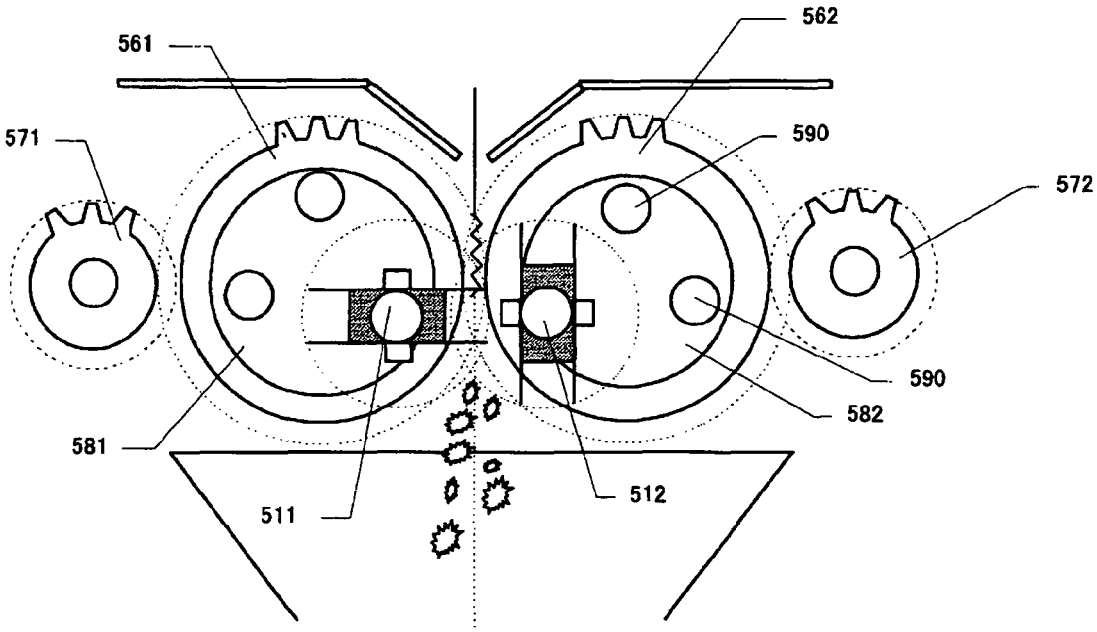
FIG. 13 is a modified example of the shredding part as shown in FIG. 11.
Figure 14:
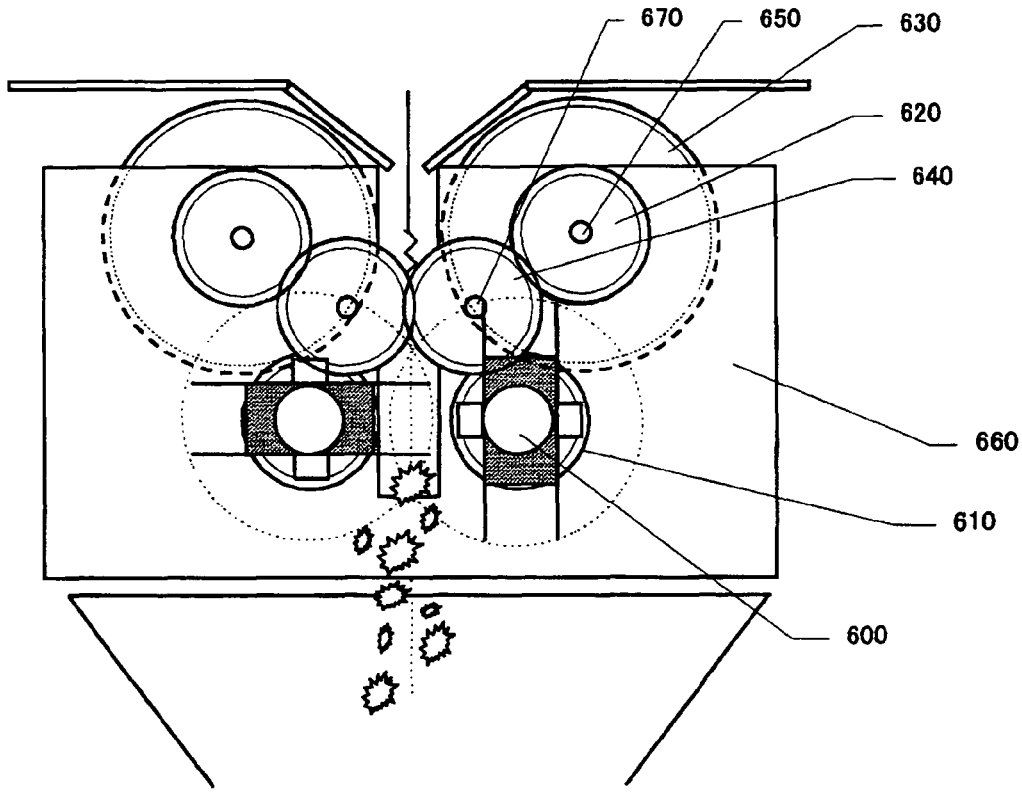
FIG. 14 is an alternative modified example of the shredding part as shown in FIG. 11.
Figure 15:
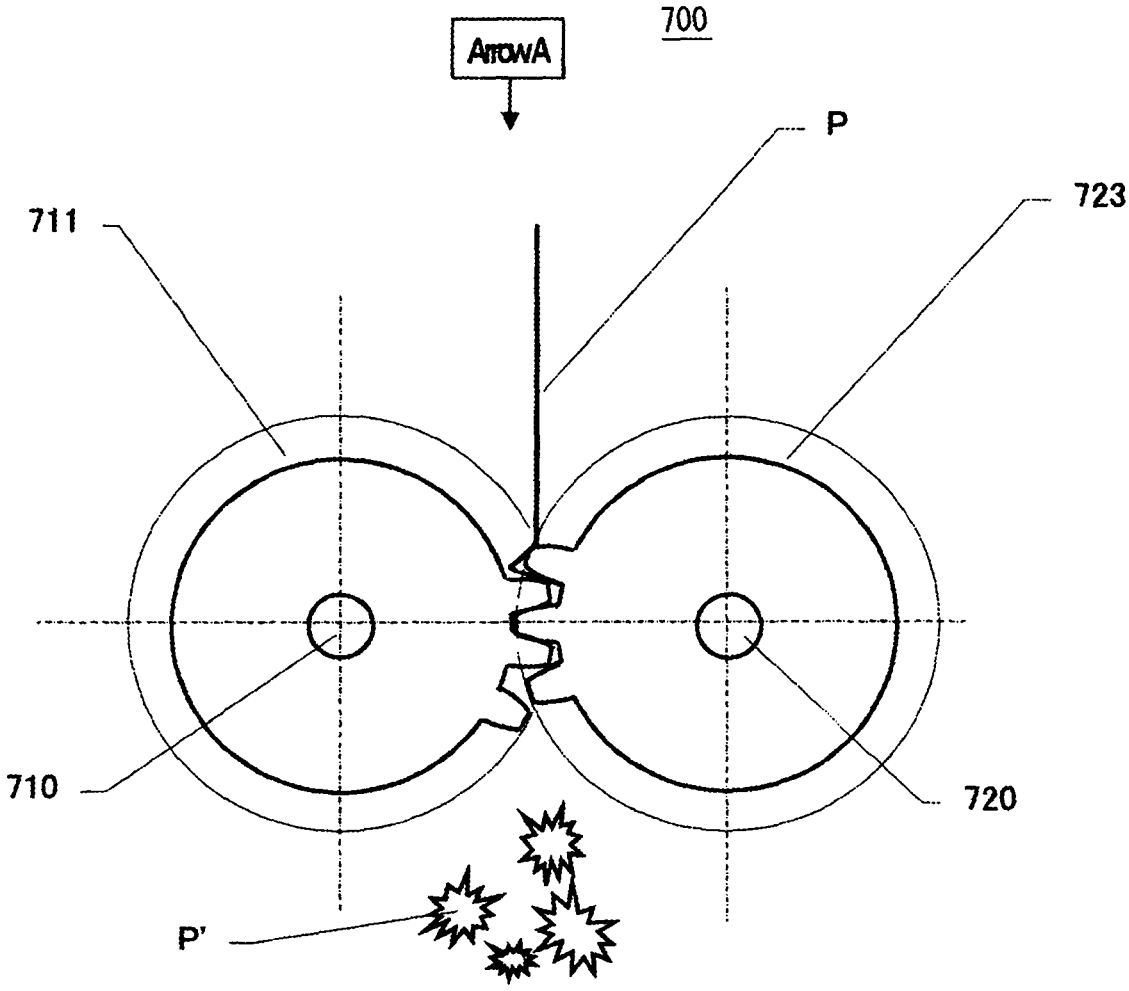
FIG. 15 is a side view of the shredding part according to the fifth embodiment.
Figure 16:
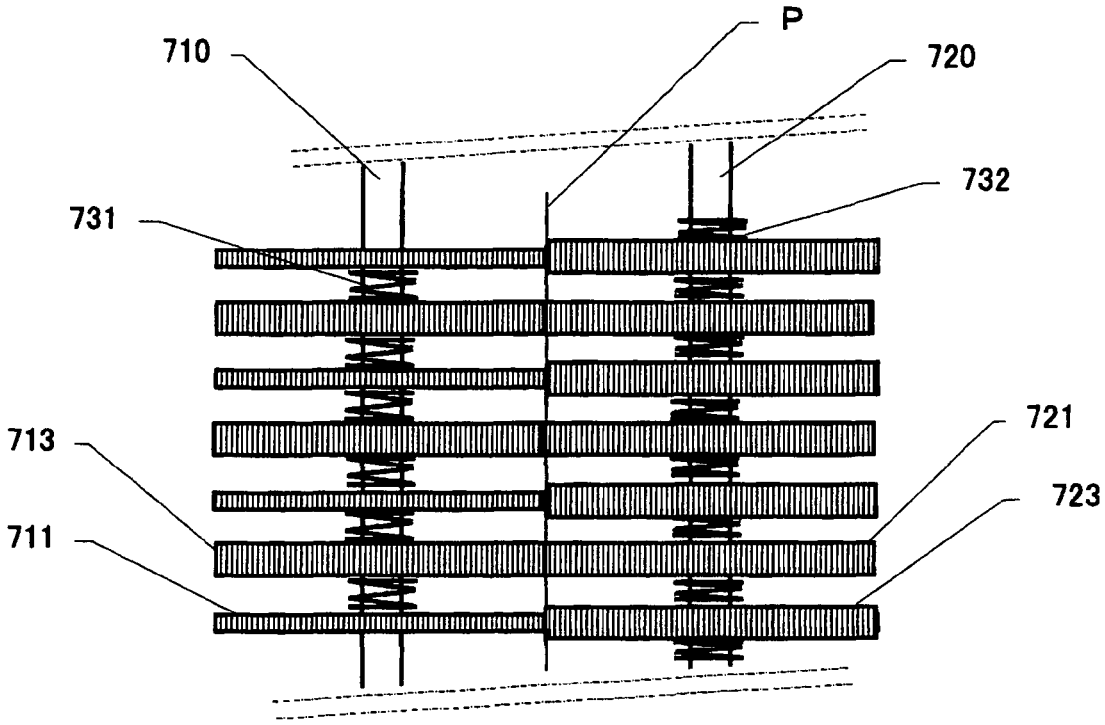
FIG. 16 is a top view of the shredding part as shown in FIG. 15.
Figure 17:
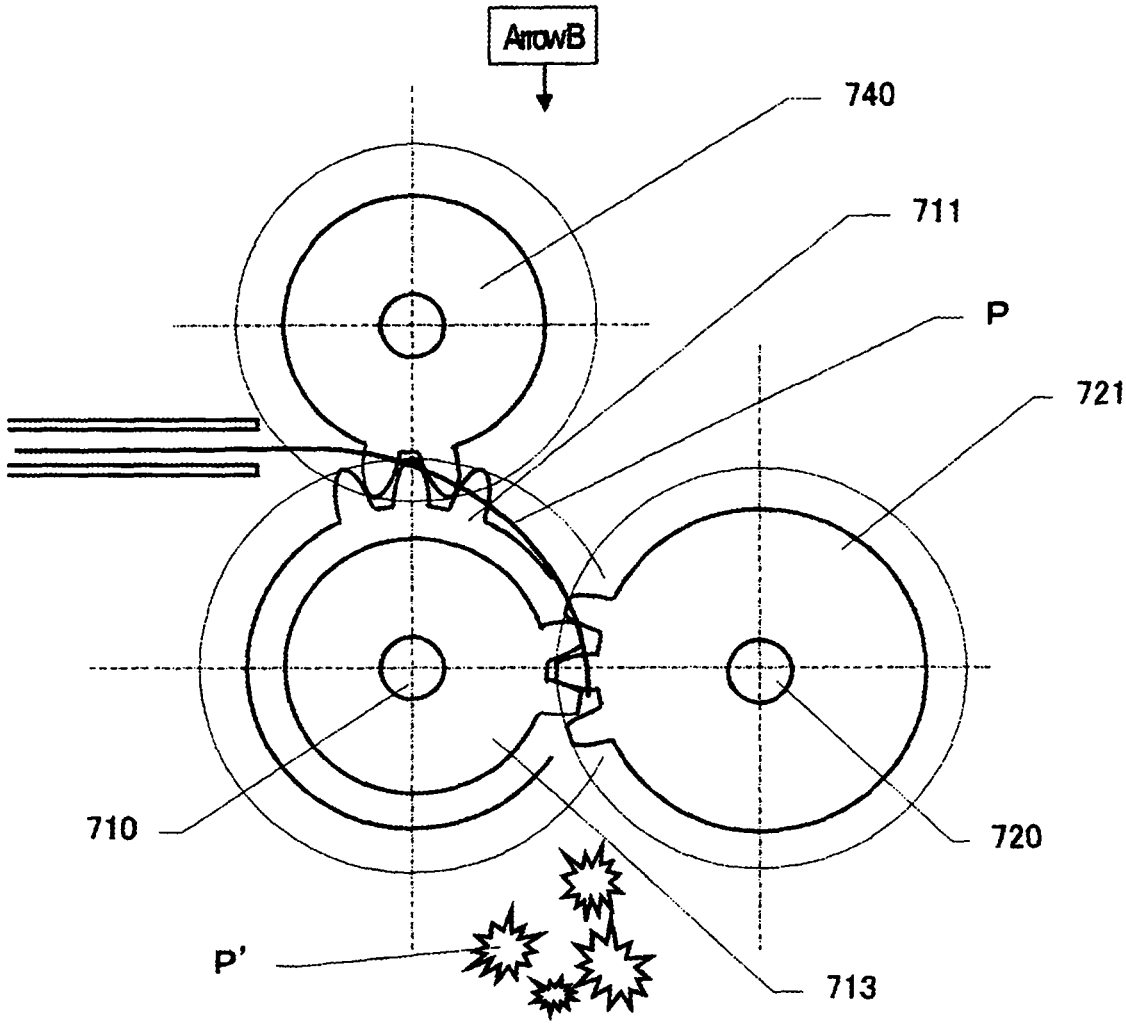
FIG. 17 is a side view of the shredding part according to the sixth embodiment.
Figure 18:
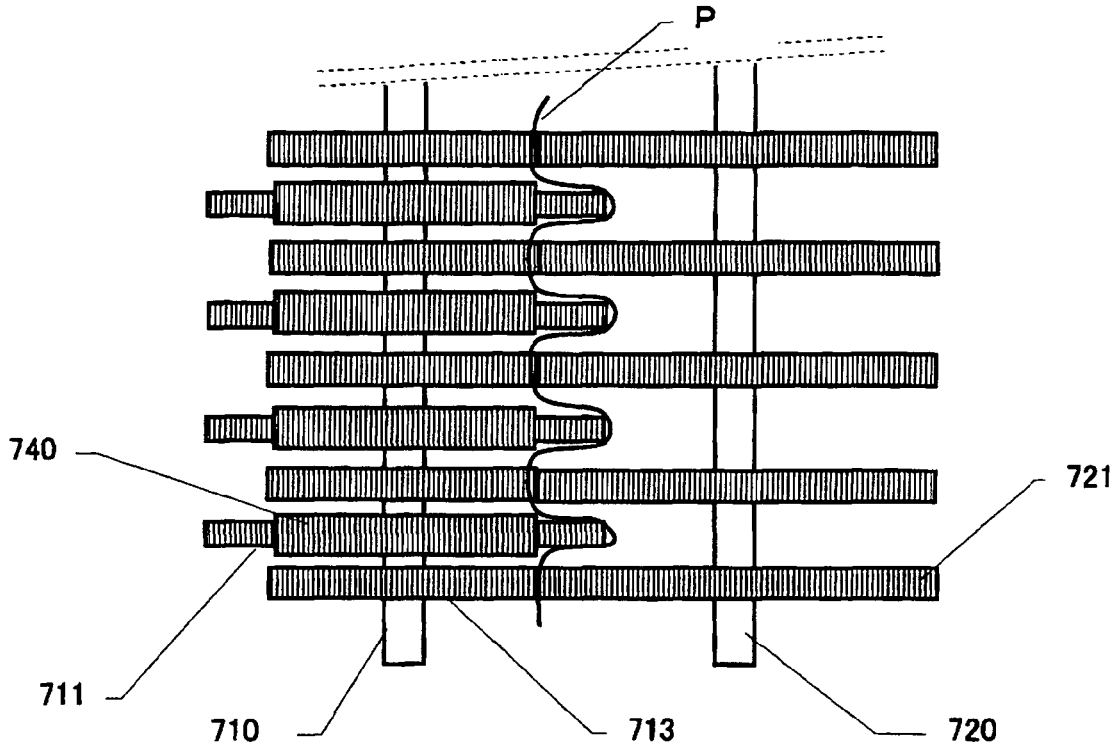
FIG. 18 is a top view of the shredding part as shown in FIG. 17.
Figure 19:
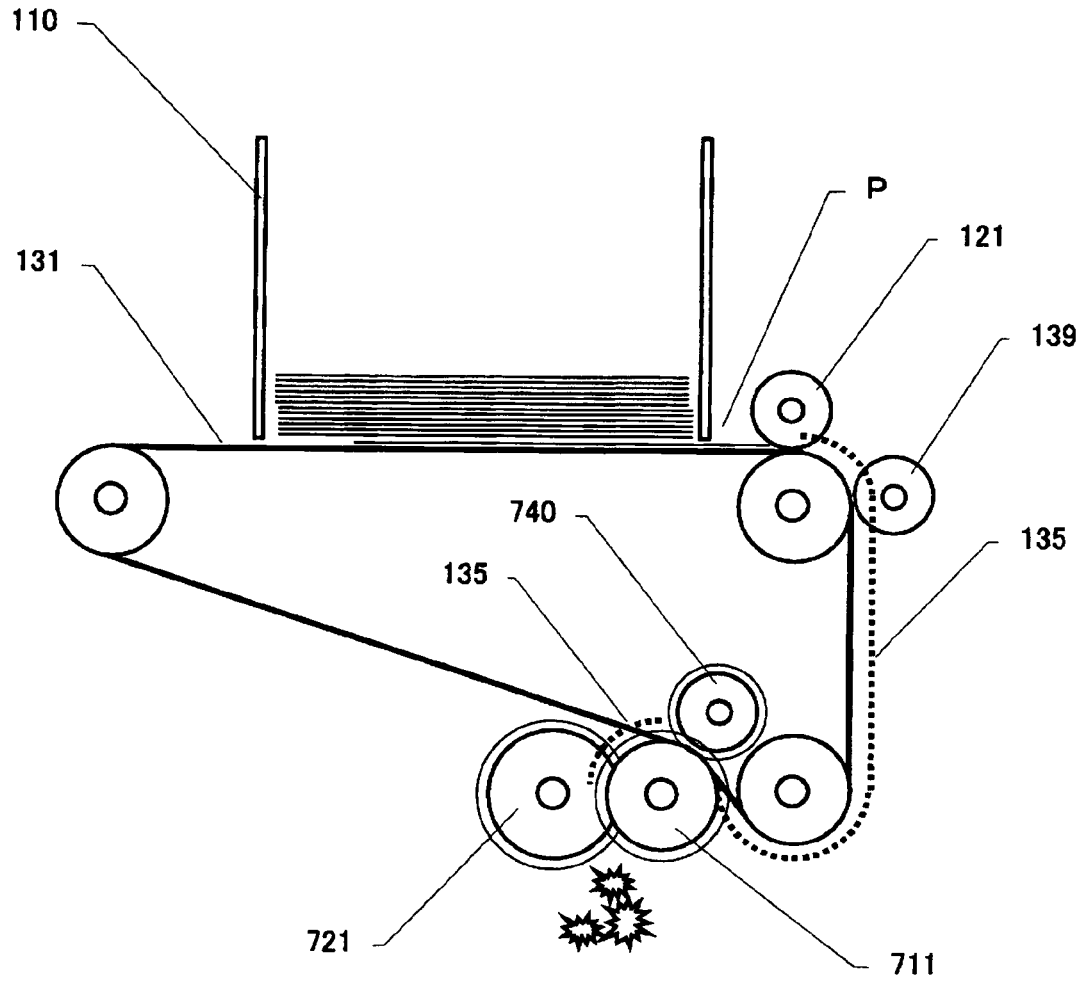
FIG. 19 illustrates a document shredder provided with the shredding part as shown in FIG. 17.
Figure 20:
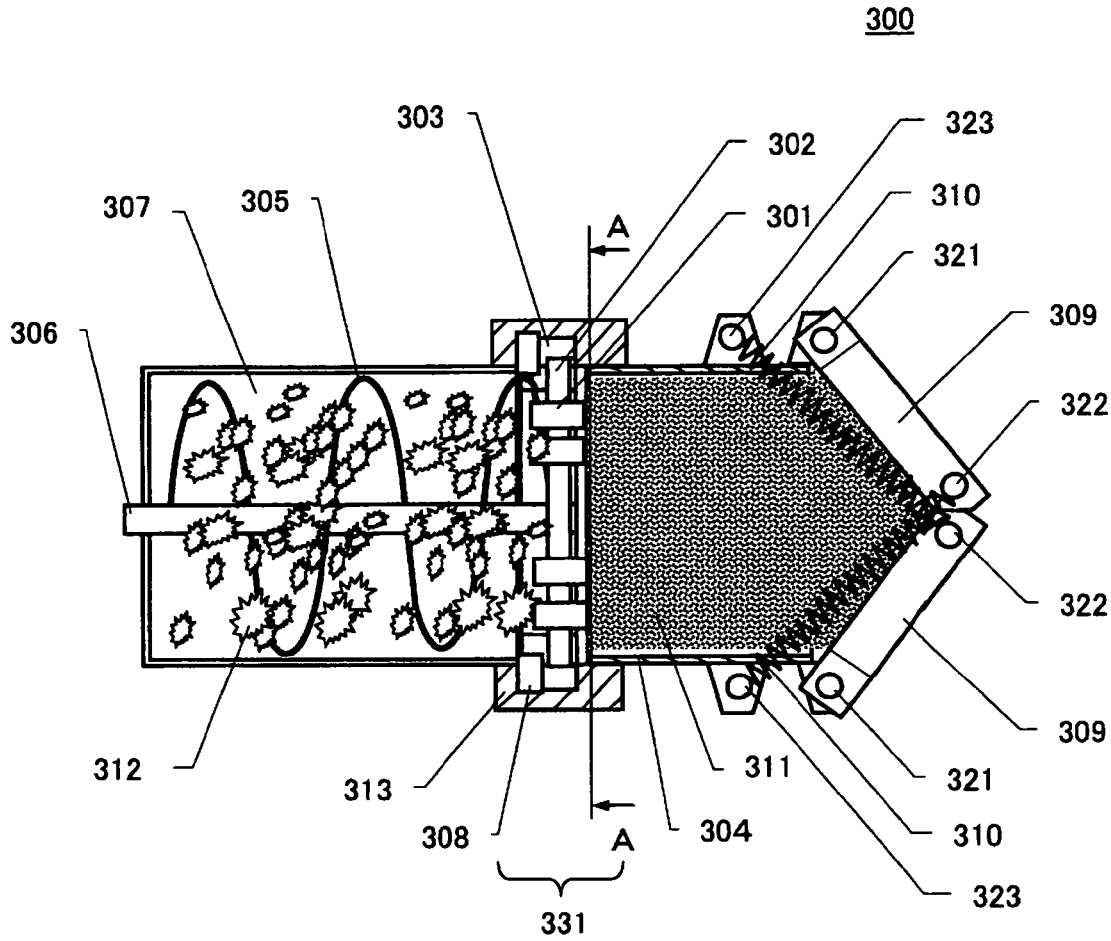
FIG. 20 is a top view of compression part, partially sectioned.
Figure 21:
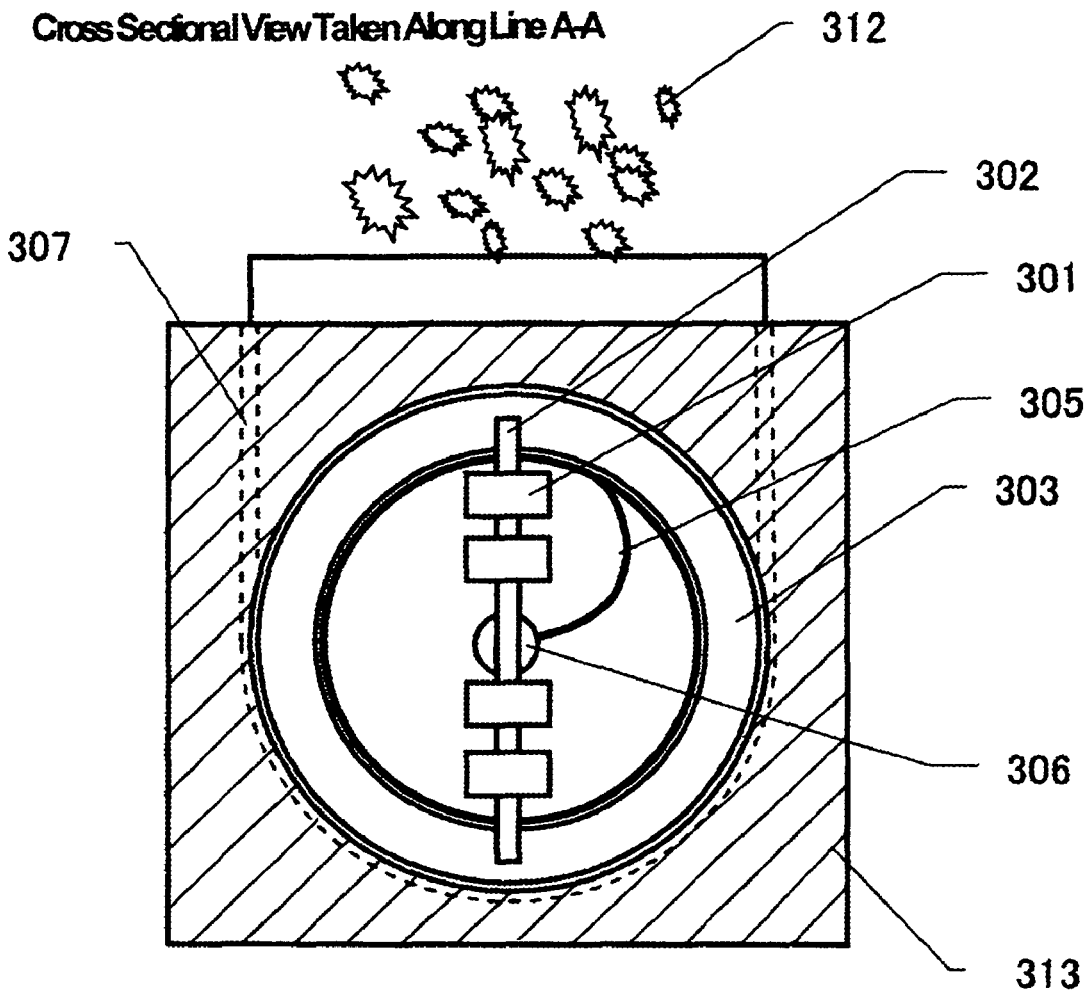
FIG. 21 is a cross sectional view of the compression part as shown in FIG. 20, taken along the line A-A.
Figure 22:
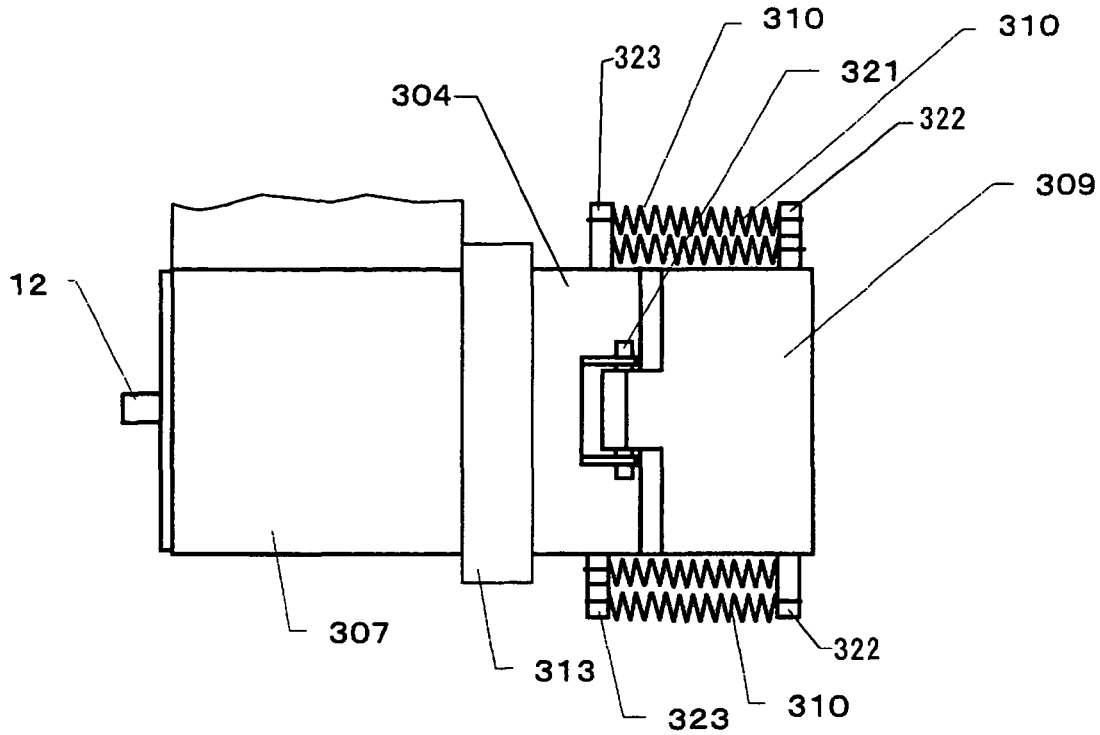
FIG. 22 is a side view of the compression part.
Figure 23:
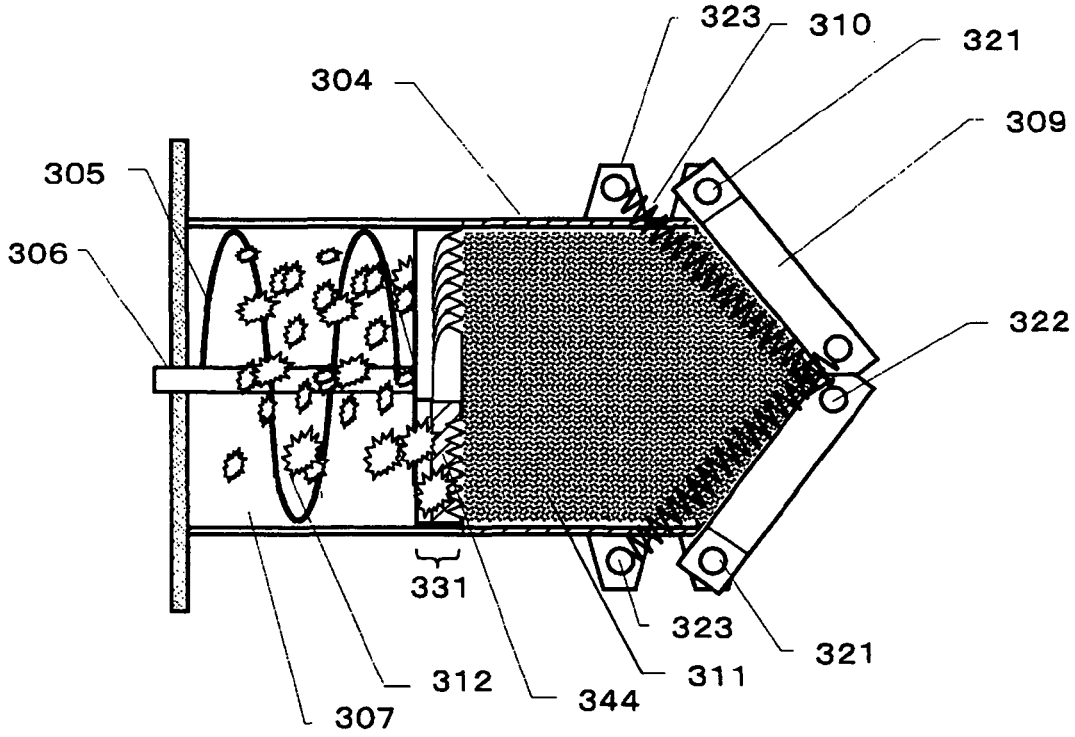
FIG. 23 is a partially sectional top view, showing the compression part in the case where a propeller is employed as a compressing mechanism part.

100 PAPER FEEDER, 110 PAPER STORAGE, 120 PAPER SEPARATION MECHANISM, 121 SEPARATION MEMBER, 130 PAPER TRANSPORT SYSTEM, 200, 500, 700 SHREDDING PART, 210, 220, 511, 521, 710, 720 SHAFT, 211, 215, 216, 221, 531, 532 SHREDDING BLADE, 213 PROTRUSION-LIKE WHEEL, 214 ROLLER, 231 BELT, 235 GUIDE, 252 HOLDING RING, 300 COMPRESSION PART, 301 COMPRESSION ROLLER, 302 SHAFT, 303 SUPPORTING MEMBER, 304 COMPRESSION ROOM, 305 COIL SPRING, 306 DRIVE SHAFT, 307 STORAGE PART, 308 THRUST BEARING, 309 COMPRESSION WALL, 310 SPRING, 311 PAPER BLOCK, 312 SHRED, 313 FRAME, 321 HINGE, 322 PROJECTION, 323 PROJECTION, 331 COMPRESSION MECHANISM PART, 344 PROPELLER, 711 TRANSPORT-USE GEAR, 713, 723 DRIVEN GEAR, 721 SHREDDING-USE GEAR, 740 PRESS GEAR

What is claimed is:

1. A document shredder comprising, a paper transport unit that holds and transports paper in a paper transporting direction and at a paper transporting speed; and a shredding unit that shreds the paper while rotating at a circumferential speed higher than the paper transporting speed of the transport unit, wherein, a component of the transport unit is also a component of the shredding, and a point of action on the paper by the paper transport unit is positioned substantially at the same position as a point of action on the paper by the shredding unit, with respect to the paper transporting direction and is spaced from the point of action of the shredding unit in a direction orthogonal to the paper transporting direction.

2. A document shredder according to claim 1 comprising a first drive shaft, a second drive shaft that is positioned opposedly to the first drive shaft, with a paper transporting passage therebetween, and that rotates at a higher speed than the first drive shaft, a transport element that is fixed on the first drive shaft and that transports paper in a paper transporting direction and at a paper transporting speed, and a shredding element that is fixed on the second drive shaft and that tears the paper, wherein, the transport element and the shredding element are arranged so that one is spaced from the other in a direction orthogonal to the paper transporting direction, and the first drive shaft comprises a shredding auxiliary unit that is rotatably driven by the shredding element that is fixed on the second drive shaft.

3. The document shredder according to claim 2, wherein, the second drive shaft comprises a transport auxiliary unit that is rotatably driven by the transport element that is fixed on the first drive shaft.

4. A document shredder according to claim 1 wherein:

the shredding unit has a rotating shaft and a shredding blade(s) fixed on the rotating shaft to tear the paper, and that rotates the shredding blade at a circumferential speed higher than the paper transporting speed of the paper transport unit, and further comprising:

a paper forwarding unit to forward the paper, being rotatably supported by the rotating shaft and engaged with a component of the paper transport unit, to hold the paper and forward the paper at the paper transporting speed of the transport unit, during an operation tearing the paper by the shredding blade, the paper forwarding unit being positioned spaced from the shredding unit in a direction orthogonal to the paper transporting direction.

5. The document shredder according to claim 4, wherein, the paper forwarding unit is a discoid member that has a large number of protrusions on the outer periphery thereof.

6. The document shredder according to claim 4 or claim 5, wherein, the shredding unit comprises, a first rotating shaft, a second rotating shaft that rotates in reverse to the direction of rotation of the first rotating shaft, and a first shredding blade(s) and a second shredding blade(s) that are respectively fixed on the first rotating shaft and the second rotating shaft and placed at locations opposed to each other, wherein, the first shredding blade and the second shredding blade are rotatively driven with a phase difference.

7. A document shredder according to claim 1, wherein, the paper transport unit further comprises, a pulley(s) that rotates about a shaft, and a endless conveyor belt(s) that is brought into contact by pressure with a peripheral plane of the pulley, and holds the paper at a pressure-contact part having an arc shape that is formed between the conveyor belt and the peripheral plane, and, the shredding blade of the shredding unit is placed inside a running passage of the endless conveying belt and in proximity to the pressure-contact part.

8. The document shredder according to claim 7, wherein, the pulley further comprises a control member at a position not interfering with rotating of the shredding blade, the control member preventing the paper held between the pressure-contact part from moving away from the shredding blade.

9. A document shredder according to claim 1 comprising:

a pair of shredding units that are fixed on a pair of drive shafts, respectively, and arranged in opposition to each other, and a pair of paper transport-use gears arranged in proximity to a component feeding paper toward the pair of shredding units, wherein, the shredding units and the paper transport-use gears are arranged in a position that at least part of the shredding units overlapping the paper transport-use gears in the paper transporting direction, and in a position that the shredding units are spaced from the paper transport-use gears in the direction orthogonal to the paper transporting direction, and each of the drive shafts has a gear where at least the shredding unit is not fixed, and the document shredder further comprises a transmission gear that decelerates power of the drive shafts and transmits the power to the paper transport-use gears.

* * * * *